US007900483B2

(12) United States Patent
Conti

(10) Patent No.: US 7,900,483 B2
(45) Date of Patent: Mar. 8, 2011

(54) INTEGRATED SYSTEM FOR CLOSING STOCKINGS ON CIRCULAR KNITTING MACHINES

(75) Inventor: Paolo Conti, Florence (IT)

(73) Assignee: N.T.A. S.R.L., Florence (IT)

( * ) Notice: Subject to any disclaimer, the term of this patent is extended or adjusted under 35 U.S.C. 154(b) by 160 days.

(21) Appl. No.: 12/301,251

(22) PCT Filed: Dec. 11, 2006

(86) PCT No.: PCT/IT2006/000842

§ 371 (c)(1),
(2), (4) Date: Nov. 18, 2008

(87) PCT Pub. No.: WO2007/135698

PCT Pub. Date: Nov. 29, 2007

(65) Prior Publication Data

US 2010/0199723 A1 Aug. 12, 2010

(30) Foreign Application Priority Data

May 22, 2006 (WO) ..... PCT/IT2006/000384

(51) Int. Cl.
*D04B 9/40* (2006.01)

(52) U.S. Cl. ..... 66/148

(58) Field of Classification Search ..... 66/58, 148, 66/43–49
See application file for complete search history.

(56) References Cited

U.S. PATENT DOCUMENTS

| | | | | |
|---|---|---|---|---|
| 5,551,260 | A * | 9/1996 | Frullini et al. | 66/148 |
| 5,570,591 | A * | 11/1996 | Frullini et al. | 66/58 |
| 5,606,876 | A * | 3/1997 | Sangiacomo | 66/148 |
| 6,164,091 | A * | 12/2000 | Frullini et al. | 66/148 |
| 2001/0017046 | A1 | 8/2001 | Rumi | |
| 2001/0039816 | A1 | 11/2001 | Fujiwara et al. | |
| 2003/0233852 | A1 * | 12/2003 | Lonati et al. | 66/17 |
| 2006/0144095 | A1 * | 7/2006 | Frullini et al. | 66/8 |

FOREIGN PATENT DOCUMENTS

| | | |
|---|---|---|
| EP | 0679746 | 11/1995 |
| EP | 0942086 | 9/1999 |
| EP | 1375719 | 1/2004 |
| WO | 2004035894 | 4/2004 |

* cited by examiner

*Primary Examiner* — Danny Worrell
(74) *Attorney, Agent, or Firm* — Themis Law

(57) ABSTRACT

A system is disclosed for closing the toe of a knit circular product, and particularly of a stocking, without a significant interruption of the sewing operation. In one embodiment, a circular device is inserted inside the cylinder used for producing the stocking, which, appropriately programmed, catches the knit fabric from under the needles and carries it to the sewing machine.

15 Claims, 23 Drawing Sheets

INTEGRATED SYSTEM FOR CLOSING STOCKINGS ON CIRCULAR KNITTING MACHINES

TECHNICAL FIELD

The present invention concerns the technical sector relative to the production of machinery for knitwear and in particular the production of machines for producing stockings and socks. More particularly, the present invention concerns equipment for manufacturing circular knitwear for the production of tubular knit fabrics of any diameter and quality of fabric.

BACKGROUND ART

Until today, machinery for circular knitwear is characterized by a continuous production through a program that establishes length and typology. A plurality of needles produces a number of shape stitches in such a way that, in a second step, the walls of the stocking are separated to enable closing of the walls of the stocking, which, until today, is carried out manually and mechanically.

More recently, autonomous mechanical accessories, to be applied by means of an interface to the circular machine, which is synergistically integrated and is inserted into the process, close the stitch. Such final step occurs, therefore on the textile members of the knitting machine, which remains engaged for a certain amount of time at the end of the knitting cycle of each product.

Such devices, therefore, though having evident automation advantages, have the disadvantage of breaking off the tubular production, by directly coupling to the rim of needles and by extending their normal manufacturing process to the closing of the toe. It is therefore evident how the production rate of the product is reduced with regard to a continuous tubular production cycle. Moreover, such devices are external to the machinery, and are always subjected during the installation, testing and in advanced production phases, to inevitable and continual checks and adjustments to allow for the perfect integration of the two different devices, that is, for the tubular production and the finishing/closing of the stocking.

In order to overcome the drawbacks of clamping arrangements of the toe in the circular machine, systems have been conceived and realized in which the completed tubular knit product is discharged from the needles and moved away from the knitting machine to be inserted in a sewing machine or darner. These systems are designed in order to engage the knit product with pick-up mechanical members, before this is discharged from the needles, so that it can be inserted in the sewing machine in a precise position, determined by the position in which the product has been taken from the needles. In fact, the seam must be carried out with a determined orientation as to the heel and to the toe formed by the fabric of the knit product.

For example, in US-A-2001/0017046, a system is described for the pick-up of tubular products produced by a circular knitting machine and for their transfer to a sewing machine. The system provides a series of hooks that are inserted into the needle cylinder of the circular machine and that, having reached a certain lifting position below the dial, expand to engage in a series of points of the tubular knit product. When the product is engaged, the hooks radially re-pull to allow the axial extraction of the product from the needle cylinder and therefore its transfer to the sewing machine.

U.S. Pat. No. 7,107,797 describes a different pick-up system of tubular knit products by a circular knitting machine and their transfer to a looping system. The pick-up is performed from above by bringing close to the needles, held in a partially raised position, a piece of equipment equipped with a plurality of annularly placed hooks. The hooks engage the tubular product along a circumference in such a way that, upon discharging the product from the needles, this is held on the hooks of the pick-up device. The latter is raised extracting from above the tubular product from the needle cylinder and so freeing the needle cylinder that can to be used for the formation of a new tubular knit product. The seam or looping of the toe is carried out by overturning a semi-arc of hooks on to the other and transferring the links from a semi-arc to the other pick-up device.

US-A-2001/0039816 describes a similar pick-up system of knit tubular products, which includes a rim of hooks brought next to the cylinder of needles from above to bring the product closer, that for this purpose is aspirated inside the pick-up device and, thanks to the aspiration, is kept engaged to the rim of hooks of the same device. This rim is then modified in its own arrangement bringing closer one to the other two flaps of the sewing point.

EP-A-679746 describes a pick-up system of knit tubular products in the circular machine that produces such tubular products by means of a couple of hooks that are approached, in a radially retreated position, to enter the cylinder space within the needles and, when the needle ring is reached whereon the tubular knit product is temporarily still engaged, one is moved away from the other, to engage in two opposed diametrical points the product which, discharged from the needles, can be extracted from the cylinder of needles to a couple of take elements.

WO-A-001869 describes a device, in which by means of a couple of hooks the tubular product is taken from the circular machine to a sewing machine where the product is engaged to the same hooks that have removed it from the needles of the circular machine. Hooks, oscillating to move one away from the other, distend the flaps of the toe to sew and insert them into the guillotine of the sewing machine.

U.S. Pat. No. 1,068,853 describes a pick-up device of a tubular knit product from a substantially equivalent circular machine to the device described in U.S. Pat. No. 7,107,797, equipped with a rim of subdivided hooks in two semi-arches. A semi-arc is overturned on to the other to transfer a semi-rank of stitches on an opposite semi-rank of stitches and therefore carry out the looping.

OBJECTS AND SUMMARY OF THE INVENTION

An object of the present invention is to avoid these and other drawbacks, providing a device that integrates the tubular production and the closing of the stocking, interrupting only for a small period the primary production of the product, and without the material flash of processes in the prior art.

The device of the present invention enables a production of the automatic type quantitatively and qualitatively superior in unit time, and without the inherent difficulties in the mechanical integration of two different production devices.

Another object of the present invention is to provide a finished product, expelled during a continuous cycle and with minimum interruptions.

The advantages that derive from the present invention essentially consist in making it possible, during the seam processing of the toe, to continue the tubular production for the following sock, such that a finished product can be obtained without further necessary work after the exit of the stocking from the machine, thereby generating a reduction of time, work and waste of materials.

In an embodiment of the present invention, a traditional tubular production system is joined to a coaxial device, inside the machinery and part of it, that causes a preset length of the tubular fabric to be inserted inside the rim of needles in precise correspondence of the finishing stitches and, by means of proper devices, to free the semi-finished tubing from the rim of machine hooks, letting these free and allowing production to continue by starting a new sock. The same device withdraws to its base position, so that an additional system, appropriately placed and autonomously supplied, can carry out the sewing process of the toe, therefore releasing later the finished product to the exterior, making it available for a new manufacturing process.

According to a different aspect of the invention, a system and a method are provided for the closing of the toe of a tubular knit product, such as a sock or a stocking, so to obtain a product of high quality with high speed, avoiding prolonged stops of the knitwear circular machine.

According to an additional aspect of the invention, a device or system are provided for producing knit tubular products for the closing of the toe upon reversal of the same product, so that the seam is carried out inside the product rather than on the outside.

In one embodiment, a system for creating the seam of the toe of a tubular knit product includes: a circular machine with a cylinder of needles; a pick-up device of the tubular knit product produced by the needles of the machine, which is substantially coaxial with the cylinder of needles of the circular machine and which has an axial movement in relation to the cylinder and in phase with it. The device carries a rim of holding hooks equipped with a movement of radial opening and closing to radially open and engage the tubular fabric produced by the circular machine, and to allow the movement of the pick-up device along the cylinder of needles, transporting the tubular knit product outside of the cylinder of needles of the knitting machine; and a sewing machine to carry out the closing of the toe. Characteristically, according to an aspect of the invention the pick-up device includes a body substantially circular, subdivided in two substantially specular portions, each of them equipped with a semi-arc of holding hooks. The specular portions are hinged, so as to obtain the overturning of a portion onto the other and therefore to mate a semi-arc of oppositely holding hooks with the semi-arc of opposite holding hooks. In this arrangement the pick-up device can allow the closing by seaming the toe, for example by placing the sewing machine below the circular machine, in a position in which the pick-up device is placed after having taken and extracted the tubular knit product to be sewn from the circular machine.

In an embodiment of the invention, the sewing machine is placed sideways, staggered to the circular knitting machine. In this case the pick-up device may be equipped with a transfer movement that converts a coaxial position in relation to the cylinder of needles of the circular machine to an alignment position with the sewing machine.

In an embodiment of the invention, a system is provided for the knitting of tubular knit products and of the seam of the toe of the tubular products that includes:

a circular knitting machine with a cylinder of needles;

a device removing the single tubular knit products from the machines needles, insertable to a cylinder space of the needles and carrying a rim of hooks equipped with a radial opening and closing movement to radially open and engage the tubular fabric produced by the circular machine and close it to allow the movement of the pick-up device within and along the cylinder of needles and to provide extraction power;

and an external sewing machine at the needle cylinder that puts in effect the closing of the tubular knit products produced by the circular machine.

In an embodiment of the invention, a flip-over member is present including two substantially semicircular portions hinged around each other to a substantially diametral overturning axis. Each semicircular portion of the dumper member is equipped with a respective semi-arc of harpoons placed in such a way that overturning a semicircular portion on the other, the harpoons of a semi-arc are placed opposite to the other semi-arc of harpoons. The harpoons of the dumper member receive the tubular knit product from the pick-up device.

With this arrangement it is possible to carry out, for example, the reversal of the tubular knit product when this is engaged to the harpoons of the dumper member, while the pick-up device is not equipped with the overturning function and only has the function to get the product from the cylinder of needles and transfer it, removing it across the same cylinder, towards the flip-over member.

According to an additional aspect, the invention provides a method for the knitting of a tubular knit product with a toe and a border for the closing of the toe of the knit product including the following steps:

producing a tubular product, starting from the border and ending with the toe, by means of a knitwear circular machine including a cylinder of needles;

maintaining the knit product with knitting members of the circular machine, inserting a rim of holding hooks in the cylinder of needles and transferring the rim of holding hooks up to a proximity of the knitting members;

radially expanding the taking hooks for engaging a plurality of stitches of the tubular product by means of the holding hooks;

radially retracting the taking hooks and extracting the rim of holding hooks from the cylinder of needles;

overturning a first semi-arc of holding hooks on a second semi-arc of holding hooks in which the rim of holding hooks is divided, carrying the stitches of the tubular product engaged by the holding hooks of the first opposite semi-arc to the stitches of the tubular product engaged by the holding hooks of the second semi-arc;

sewing together the opposite stitches to close the toe;

discharging the product from the holding hooks.

In an embodiment, the invention provides a method for the knitting of a tubular knit product with a toe and a border and for the closing of the toe of the knit product, including the following steps:

producing a tubular product, starting from the border and ending with the toe, by means of a knitwear circular machine including a cylinder of needles;

maintaining the knit product with knitting members of the circular machine, inserting a rim of holding hooks in the cylinder of needles and transferring the rim of holding hooks up to proximity of the knitting members;

radially expanding the taking hooks for engaging a plurality of stitches of the tubular product by means of the holding hooks;

radially retracting the said holding hooks and extracting the rim of holding hooks from the cylinder of needles;

ranging in line the rim of holding hooks to a rim of divided harpoons in a first semi-arc and a second semi-arc of harpoons;

transferring the stitches engaged by the holding hooks to the harpoons;

overturning the first semi-arc of harpoons on to the second semi-arc of harpoons carrying the stitches of the tubular product engaged by the first semi-arc of harpoons opposite to the stitches of the tubular product engaged by the harpoons of the second semi-arc;

sewing together the opposite stitches to close said toe;

discharging the product from the harpoons.

Possible further advantageous characteristics and embodiments of the invention are outlines in the claims that follow and will be described in greater detail herein with reference to the enclosed figures.

DETAILED DESCRIPTION OF FORMS OF REALIZATION OF THE INVENTION

A first embodiment will be described with reference to FIGS. 1-21.

A traditional tubular knit production system includes a rotating annulus of needles on a support cylinder that produces the knitted tubing according to a method known in the art. With a coaxial arrangement with respect to the cylinder, a downwards hollow sliding chamber is provided, which is movable with respect to the knitting machine. Inside such duct slides an additional guided device from an external ring having a guide system, which positions the same device concentrically with the production machinery.

Integrated with the guide system is placed the withdrawal mechanism (4) that mainly consists of an annulus of holding hooks (8), providing a diameter appropriately reduced, divided in two specular overturnable halves (5, 6) on themselves by means of a specific hinge (7), with the final task laying in the end seam of the stocking, by means of a semi-circumference precisely overturning the holding hooks on to the other, relatively fixed. The running circular cavity of the withdrawal mechanism (4) is appropriately closed, in order to be able to use pressure or suction to orient and put in traction the knitted tubing constituting the stocking according to an advantageous direction. Alternative constructive choices are possible without modifying the spirit and scope of the invention.

In any case, the internal cavity is equipped with a special valve to allow the expelling of the finished product.

Essentially, the machinery is built to completely integrate the knitting-machine and tubing functions of the productive machine (1), withdrawal mechanism (4), and closing terminal system, because the same integrated machine can interchange the complementary movements between the different systems, such as transportation tapes, cams, tyre cylinders, production needles, and insertion hooks.

The operative process can be summarized as follows:

A first step provides the development of the tubing constituting the stocking by the rim of the main needles, which working method is common to all circular knitwear machines. After completing the production of the preset length of the tubing, already placed gravitationally downwards, in a concentric position with respect to the connecting tube of the withdrawal mechanism (4), a suction is carried out inside the pipe that, thanks to the different conformations of the material of the stitches suitable to the aim of the tubing, determines a longitudinal circular lengthening of the tubing along the entire circumference. The drawing mechanism (4), mechanically transferred near the aforementioned circumference, operates a first movement of radial phasing with the main cylinder, by means of the clutch of a latch (22), integral with the device, that is inserted inside of a placed cam near the productive theatre, moreover the aforementioned function, thanks precisely to its internal circular shape, determines the circular enlarging of holding hooks.

These hooks suitably extend upwards toward the circumference of diverged stitches thanks to the suctions that the product goes through. Such operation is further facilitated by the elasticity of the material constituting the final courses of the semi-finished product.

It is therefore possible to insert the rim of needles of the transfer device in the appropriate final stitches of the tubular product. It is appropriate to underline that, at the end portion of the tubular product, the final knitted turns of the product are manufactured from a different material (Lycra), which is much more elastic with respect to the cotton constituting the stocking. This facilitates, during the suctions, the lengthening of the stitches, allowing a precise and safe hold with respect to the movable support of the tubular product. Moreover, the elasticity itself of the material allows a safe hold on the holding hooks which takes the stitch (13).

The following step provides for the lowering of the device and therefore, thanks to the same contribution of the concentric cam ring present in suitable position on the machinery, the holding hooks re-enter on the tubing at the height of the cotton upper course (18).

It is important to note that, even if in this end step the tubing is still constrained to the main machine, the machine is still in a working arrangement, therefore, the operations carried out at that moment do not constitute any restoring of the main production.

Subsequently, the return step of the movable device, vertically re-crossing the same cam, provides for the return of the movable device coupled with the semi-finished product, removing the last knitted turn made from the needles of the knitting-machine the machine, which can start the production of the following piece.

An additional cam, interposed with respect to the integrated final toe sewing system, and in tangent position, allows the positioning of holding hooks in correspondence with the radial opening to provide the material to a sewing needle.

The device moves then to a predefined position for the overturning of a semi-circumference, therefore bringing in contact the two designated semi-circumferences for subsequent connection.

The two coupled flaps are then sewn by the needle, which, coming across them, creates a first resistant and thin interlacing point that catches the stitches of the flaps, starting the semicircular final seam.

Reduced to its essential structure and hereto to the figures of the included drawings, a system for the seam of the toe of a tubular knit product according to the present invention includes a circular device (4), coaxial to the machine (1) that produces the tubing, inserted and coaxial inside the cylinder of the machine (1). Circular device (4) carries a rim of holding hooks (8) hinged at a point (9) that opens for hooking the stitch below the needles (2) and that, after the machine (1) has freed the stitch (3) for starting a new working phase, the device (4) drops and drags the circular product, transporting it to the sewing machine that carries out the closing of the toe.

To allow a safe and precise hold of the holding hooks (8) on the product (12) the system provides that the cylinder (1) that manufactures the tubular product is programmed to produce the end portion of the product in material that is not elastic (13), and later knit some knitted turns (18) with an elastic yarn such as Lycra. The easy expansion of the stitch turn (18) allows the insertion of holding hooks (8) within the stitch (13) causing a tie effect, clasping to the neck of the terminal curved portion of the hooks.

When the rim of needles (8) opens, the holding hooks are inserted within the stitch (13) at a distance, which thus invites the insertion of holding hooks. At that point the cylinder, which has completed the working of the tubing, frees the tubing letting the stitches (18) compress and go with the approaching hook. This result is obtained thanks to the elastic material from which the stitches are produced in the end portion of the manufacturing of the stocking.

Advantageously for superimposing the two terminal semi-circumferences of the tube to sew, the device (4) has a rim of holding hooks (8) produced in two specular halves (5) and (6) hinged at a point (7) in order to allow the overturning, thanks to the said hinge (7), of the free semi-circumference of holding hooks (5) on the constrained half (6), carrying the holding hooks (8) reaching the end of the material, in speculated vertical symmetrical position, as evidenced in the detailed view of FIG. 14.

Advantageously the holding hooks (8) are integral with the device (4) by means of a pin (9) that constitutes fulcrum for the opening of holding hooks.

The invention provides that the device (4) can operate in different ways.

In one embodiment, a cam is provided (10), placed behind the main cylinder (1), having a slot (10A), in which a mating key (22) is inserted, which is coupled with the device (4) and provides a radial orientation to the cam and to the needles.

The rim of needles (8) is opened with precision, at a predetermined moment. To this aim, cam (10) is provided, placed behind the main cylinder (1), having a slot (10B) that allows the enlarging of the holding hooks providing for the easy insertion through the last produced semi-finished product turns. At the moment in which the device (4) ascends vertically inside the cylinder, the rim of needles (8) is closed (FIG. 1, FIG. 3) and remains such till when the position of the cylinder does not reach the upside of the cam (10). In proximity of the slot (10B), the holding hooks, hinged at point (9), are not maintained close by the wall of the tubing any more and the cylinder opens a width corresponding to the width of the slot, that is, until the exterior of the cylinder does not tap on the internal surface of the slot (FIG. 5). In this phase the holding hooks are open and hook the stitch (13) as evidenced in FIG. 6.

After hooking the stitch, and the product is separated from the cylinder (1), the device (4) vertically falls downwards and when going over the slot (10B) of the cam (10), the holding hooks close and the device is free to move, dragging the hooked product to the holding hooks by means of the toe as shown in FIG. 7 and in the FIG. 8. The toe has been taken with the inserted hook in the wide stitch (13) and the remaining stitches (18) are grouped given to their elasticity.

Since the device comes up from behind to the sewing machine the rim of holding hooks must open to facilitate the following overturning of a circular section (5) and therefore to carry out the sewing of the seam.

To such an end in the tubing containing the device (4), near the sewing machine, a movable cam (15) is provided that, surpassing the device (4), allows an excursion of holding hooks to open the desired distance (FIG. 11), again being free to rotate on the pin (9).

The overturning of the rim of holding hooks on the hinge (7) causes the overlap of at least two flaps of the stocking to sew (FIG. 13, FIG. 14). The overturning of a half-crown of holding hooks can be carried out with different means. For example, a piston can be provided that acts on a semi-circumference pushing it on the other. Obviously the opening of the rim of needles occurs to the exterior of the tubing (25) or in a part of the said tubing of greater diameter in respect to the remaining in order to allow the overturning.

The circular device (4) moves vertically inside the cylinder through any movement system that couples it with the cylinder but lets it be free to move. As an example, it is possible that a guide that slides inside the cylinder, and the tubing (25) connected with it, drags the device (4) vertically to get the knit fabric and therefore to drag it to the sewing machine. The transportation mechanism can be designed in order to realize a single tube (25) connected to the cylinder (1), which presents a bend (FIG. 19) in such a way that since the device (4) taking the stocking moves it inside the pipe into to the exit up to find the sewing machine not visible in the drawing of FIG. 19. In this case the device (4) moves inside the aspirator used for the formation of the stocking.

In this embodiment, when the device (4) moves beyond the bend, it drags the stocking that is above the same device, held still in such position by the suction. At the moment in which it arrives to the sewing machine, the rim of needles (8) opens and the toe of the stocking is seamed by flapping over the two flaps of the stocking.

In this embodiment, since the device (4) has moved beyond the curve, it is possible to facilitate the downward descent of the product (FIG. 19) by means of a passing-through cylinder that pushes it down, by means of aspiration or any other means, after which the rim of needles (8) opens for carrying out the seam of the toe that occurs in reverse over-flapping of stocking flaps.

In a different embodiment, the device (4) moves on the inside of a pipe, once the cylinder has descended dragging the stocking, it is moved away from the cylinder to which it is applied by an aspirator, and the pipe containing the device (4) is transferred into an axial position with the external sewing machine to the cylinder that produces the product.

The seam can be carried out with any known art, but preferably the following sewing system is used that ensures a greater stability to the seam itself.

To finalize the product a movable sewing machine is provided (20/21/16) placed radially, equipped with sewing needles (16) and capable of rotating 180° for sewing the whole length of the toe. The sewing machine is dynamically synchronized with the various phases of the main knitting-machine (1) and the device (4).

The invention includes means to move transversally and vertically the sewing machine and the related needle (16) with devices known in the art.

The sewing machine, schematically shown in the FIGS. 15-18, has a needle (16) that carries out a first vertical movement (S), realizing a first point using thread (19) received from spool (20) across crochet (21). Later the needle (16) of the sewing machine operates a movement (S1) outside of the manufactured toe, after which the needle (16) is lowered again (S2) to pick up the thread (19) by means of crochet (21). Finally (FIG. 18) the needle (16), with vertical and translatory movement (S3/S4) moves upwards imprisoning the stitches (17/18), so forming a tie (14) external to the sock, which is resistant and thin.

The following operations involve repositioning the system after completing production by the circular knitting-machine of the semi-finished product.

Another embodiment of the invention relates to the closing of the toe, upon overturning the semi-finished stocking.

In this embodiment, the needle is inserted between the two coupled flaps, crossing them, and creating a first resistant and thin interlacing point that imprisons both stitches of the flaps, causing the starting of the semicircular final seam.

The present invention can be applied to all circular type machines and provides the advantage of allowing the seam of the toe at the same time that the stocking is produced, because the cylinder has detached the finished product, the product has been caught by the device (4) that continues its movement while simultaneously the cylinder (1) begins to work on a second product.

By using automation of the electronic or mechanical type, the production times of the final seam can be synchronized with those of the production of the following semi-finished product. Such contemporary operation allows a sharp increase in the productivity of the product in comparison with present technology.

The above described productive increase is coupled with saving considerable amounts of raw material.

The present invention relates to a system for seaming the toe of a tubular knit product that includes a circular device (4), coaxial to the machine (1) that produces the tubing. The circular device (4) is inserted inside the cylinder of the machine and carries a rim of holding hooks (8) hinged at a point (9) that open for hooking the stitch below the needles (2) and that, after the machine (1) has freed the knit fabric (3) for starting a the next piece of tubing, drags the circular product to the sewing machine that performs the closing of the toe.

The cylinder of the machine (1) that produces the tubular product is programmed to work the end portion of the product with some knitted loops (18) realised with an elastic yarn such as Lycra, such that the easy expansion of said knitted loops (18) allows the insertion of holding hooks (8) within the stitch (13) that is broader than other stitches, thus facilitating the insertion of the holding hooks.

The device includes a circular body (4) having a rim of holding hooks (8) disposed in two symmetrical halves (5) and (6) hinged at a point (7) in order to allow the overturning, thanks to the hinge (7), of the free half circle of holding hooks (6) against the other constrained half (5), carrying the holding hooks (8) having the end of the fabric in a vertical symmetrical position facing the other hooks.

The hooks (8) are coupled with the device (4) by means of a pin (9) that provides the fulcrum for the opening of holding hooks.

The holding hooks (8) are at least double in number in comparison to the needles of the cylinder (1) that produces the tubing.

The device (4) is in-phase with the cylinder (1) by means of a cam (10) placed behind the main cylinder (1), which is equipped with a slot (10A), inside which there is inserted a key (22) coupled to the device (4) that provides a radial orientation to the cam in relation to the needles.

The cam (10 is placed behind the main cylinder (1), and includes a slot (10B) that allows the enlarging of hinged holding hooks in the point (9). The hooks are then no longer restrained by the wall of the tubing or the cylinder, and open to the preset width, inserting into the last portion of the semi-finished product turns.

The rim of take hooks of the device (4) opens to facilitate the following overturning of a section (5) of the rim, allowing it to carry out the seam.

Inside the tubing containing the device (4), near the sewing machine, a movable cam (15) is provided that, extending beyond the device (4), allows an excursion of the holding hooks, which open at the desired distance and are free to rotate by being hinged on the pin (9), and therefore to overlap of at least two flaps of the stocking to sew when the half rim is rotated about hinge (7).

The circular device (4) moves axially inside the cylinder along a guide that slides inside the cylinder, causing the device (4) to engage the knit fabric and drag it to the sewing machine.

In one embodiment, the cylinder (1) is disposed inside a tube (25) having a U-shaped bend in such a way that the device (4), after engaging the stocking, moves downwards first and then along the bend, moving upwards but in upside down position compared to the descent position.

The device (4), once the bending of the pipe (25) is overcome, drags the stocking that is over the same device, held still in that position by the aspiration realised inside the pipe, going on to open the rim of needles (8) and to sew the stocking by over-lapping two flaps.

The product connected to the device (4), once over the bend, it is pushed downwards by aspiration or other means, after which the rim of needles (8) opens for carrying out the seam of the toe that occurs from upside down by over-flapping the flaps of the same product.

To close the product, there is provided a translating sewing machine (20/21/16) placed radially, which is equipped with sewing needles (16) and may rotate 180° for sewing the whole length of the toe, and which is synchronized with t the main knitting-machine (1) and the device (4).

The sewing machine and the relative needle (16) shift transversely and vertically.

The seam of the product occurs through the following steps:

- vertical movement (S) of the needle (16) that realizes a first point in the loop (17) of thread (19), received from the spool (20) and across the crochet (21);
- movement (S1) of the needle (16) of the sewing machine, outside the manufactured point and of the residual portion of the stitches (18);
- lowering (S2) of the needle (16) to take the thread (19) by means of the crochet (21);
- vertical and translating movement (S3/S4) of the needle (16) that goes back catching the stitches (17/18) and so forming a tie (14) external to the sock, and resistant and thin;

The sewing system operates on the reverse of the product, by means of appropriate movements of the needle between the two coupled flaps, coming across them, and creating a first resistant and thin interlacing point that catches both loops of the flaps, starting the semicircular final seam.

With specific reference to the figures the following is noted.

FIG. 1 shows a sectional view of the main knitting system (1) made up essentially of a rim of needles (2) producing the knitted tubing (12) until point (3). The withdrawal device of the product (4) is disposed axially, and includes two semi-cylinders (5) and (6), hinge in (7) to allow overturning of the semi-cylinder (5).

Such device includes a rim of holding hooks (8), engaged at two semi-circumferences in order to allow a radial excursion, by means of a hinge point (9). The holding hooks are shaped at the head to suitably insert between the stitches of the tubing (13) and hook with it thanks to the upper bending, in the underside, downstream of the hinge point (7). The hooks have a shape suitable to be actuate by a cam (10), placed behind the rim of needles (2) that produces the product. The two devices (1) and (4) are coaxially aligned, thanks to the guide system (11), containing the device for withdrawal and transportation (4) inside the pipe (25), as disclosed in FIG. 2, related to a plan section of the device.

FIG. 3 shows a first step of operation of the presently described embodiment, in which the device (4) moves behind the main knitting-machine (1), vertically shifting under and in the center of the needle cylinder (2). In FIG. 3 there is also shown the position of the cam (10), coupled to the cylinder (1). Furthermore, there is shown the latch (22) that, in the vertical insertion of the device (4), is inserted inside a special slot (22A), which allows the integral clutch and the synchronization with the cylinder (1), thereby realizing a radial orientation as to the cam and to the needles.

The position of last stitches made by the knitting-machine (1) by means of needles (2) is illustrated in detail in the FIGS. 3 and 4, which show that an aspiration (P), created inside the coaxial channel, determines the lengthening of the stitches, prearranging them to the insertion of holding hooks (8) in the stitches (13).

In FIG. 5, there is shown the climbing of the device (4), beyond synchronization of the device with the main machine (1). A latch (22), catching on cam (10), causes the enlarging of hooks (8) by rotating on the point of hinging (9) and by suitable radial opening, as disclosed in detail on FIG. 6. The aforementioned stitches, made of a material different from the rest of the product, define a number of openings. These stitches are woven with an elastic yarn (18), for example Lycra, for facilitating the following seam of the toe.

The cylinder (1) then does an empty knitted turn to allow the detachment of the stocking (18) from the needles (2).

FIGS. 6 and 7 show the semi-finished product (12) taken by the device (4), running vertically, wherein a portion of the product (12) necessarily moves by the same cam (10) that had determined the enlarging of holding hooks (8). Cam (12), during the descent, allows the return of holding hooks (8) again closing them down while connected to semi-finished product (12).

FIG. 8 illustrates a detail of the head to the hook (8) after catching the thread (13), moreover evidencing that the elasticity of the remaining stitches (18) upstream of the hook (8) reduces encumbrance.

FIG. 9 illustrates the descent of device (4) towards cam (15), having internal shape such to act again on the base of holding hooks (8), by means of a hinge (9), as disclosed in FIG. 10 and such to establish a new enlarging of the holding hooks. The cam (15) is in proximity of the sewing machine. FIG. 10 shows a detail of FIG. 9, in which there is evidenced the cam (15) and the underside of the holding hook (8).

FIG. 11 illustrates precisely such a crossing by showing the device (4) with the hooks (8) having the semi-finished product (12) and crossing the cam (15) prior to overturning. Such situation is illustrated in greater detail in FIG. 12, where the action of the cam (15) at the base of the hook (8) is shown that rotates with preset radial excursion by means of a hinge (9), supporting the interacting of the cam (15).

FIG. 13 illustrates the overturning of the device (4) that, on the upper hinge (7), overturns the free semi-circumference of holding hooks (5) onto the constrained other half of the circumference (6), carrying the holding hooks (8) having the end of the fabric, in vertical symmetrical position, as evidenced in FIG. 14.

The device is now ready for the final seam.

FIG. 15 shows a sewing machine, shown schematically with its terminal needle (16) that carries out its first vertical movement (S), effecting a first loop (17) of thread (19), received from spool (20) across the crochet (21).

FIG. 16 illustrates the following step, in which the needle (16) of the sewing machine operates a movement (S1) outside the manufactured point, and residual stitches (18).

Later (FIG. 17), the needle (16) moves downwards (S2) to take the thread (19) by means of crochet (21).

Finally, (FIG. 18) the sewing needle (16), with vertical and translating movement (S2/S3), moves upwards restraining the stitches (13/18), so forming a tie (14) external to the sock, which is resistant and thin.

Therefore, the above described operations are performed the following production by the circular knitting-machine of the semi-finished product.

Another embodiment of the invention is depicted in FIG. 19, which shows a schematic cross section of the machine, which includes a curve portion and provides a coaxial guide (25), with the support of gravity and mechanical retention.

FIGS. 20 and 21 illustrate the present embodiment in detail. The fabric (18), hooked to the hook (8) directed by the same cam (15), once again superimposing, by means of overturning, the semi-circumference of opposite holding hooks (8). Using the same process that was previously disclosed, the final seam of the toe is obtained on the internal side of the stocking, with a better albeit slower final qualitative result.

FIGS. 22 40 will now be described.

FIGS. 22 to 40 show a different embodiment of the invention and of the related method for the knitting of knit tubular products and for the closing of its toe.

In this embodiment, the system provides for a circular machine for knitwear 501 equipped with a cylinder of needles 503 and of a dial 505. Reference numeral 507 indicates the needles for the formation of the stitch and reference numeral 509 indicates the machine hooks of dial 505.

Below the cylinder of needles, a tubular member 511 is provided, on the inside of which the tubular knit product is aspirated, indicated as M, which is gradually produced by the knitting members of the circular machine for knitwear 501. Tubing 511 can be inserted and disengaged on the inside, with an axial movement parallel to the axis of the cylinder of needles, while a pick-up device of the product is indicated with 513 and described in greater detail below.

Knitting machine 501 is associated with a flip-over member 515 that has the function of overturning, one onto the other, two complementary flaps of an open end of the product M so to allow the seam to be closed by means of a sewing machine 517 close to member 515. As will be described below, in this embodiment the pick-up device 513 has the function of getting the knit tubular product M from the circular machine 501 and of transferring it into the adjacent flip-over member 515. Once flip-over member 515 has received the tubular knit product, it engages product M with harpoons and begins the overturning from one onto the other of the two flaps defining the open end of the product. Differently from what described with regard to FIGS. 1 through 21, therefore, the pick-up functions of the product and the overturning of one onto the other of two flaps to be sewn is based on different mechanical members, providing advantages that will be understood by those skilled in the art.

The pick-up member 513, disclosed in greater detail in FIG. 22A, includes a cylindrical support or stanchion 517, whereon a cylinder is fixed 519 that is grooved. The holding hooks 521 are housed in the grooves and form a rim around axis A-A of the pick-up device 513. For drawing simplicity, in the figures there are only illustrated two holding hooks diametrically opposed along the rim, lying on the section plane, but it should be understood that the rim includes a plurality of holding hooks between them, which are substantially identical and in suitable number to achieve the desired fineness of the stitch of the fabric.

Each holding hook 521 is oscillating around an oscillation point 523 and may extend outwardly. Radial movement of the holding hooks is generally defined as a movement, by means of which an extremity of holding hooks extends outwardly from the axis of the device. Such radial movement provides for a radial extraction and an oscillation movement. However, such movement can be for example a movement of translation, for example along an essentially orthogonal plane to the cylindrical support of the needles.

The movement of extraction, may it be oscillatory, translatory or other, can be actuated in different manners. Preferably, as shown in the embodiment depicted in the drawing, the oscillation is commanded by a substantially conic cam profile 525, provided on a cursor 527 axially sliding along the grooved roller 519. The cam profile 525 simultaneously cooperates with all the lower ends 521A of holding hooks 521. The relative sliding between the cursor 527 and the rim of holding hooks 521 causes the inwardly-directed radial push of the ends 521A of holding hooks with a consequent outward radial movement, because of the oscillation around the higher points 523, end 521B of the holding hooks. This movement serves, on the one hand to engage, with the holding hooks 521 the tubular knit product M when this product is in the circular machine 501 and, on the other end, to bring the stitches engaged by holding hooks 521 on the harpoons of dumper member 515 as described below.

To carry out the relative axial movement between the cursor 527 and the rim of holding hooks 521, t a cylindrical element 529 is placed that forms an upper recess 531, shown in detail in the enlargement of FIG. 22B. In this figure the system is shown in the arrangement, in which the pick-up device 513 has been brought to the cylinder space of the needles and has holding hooks 521 wide apart ready for receiving the tubular product M as soon as released by the dial 505, according to an operating cycle that will be described hereinafter beginning with FIG. 23. In FIG. 22B the needles are omitted as well as the other knitting members of the cylinder, for the sake of drawing simplicity.

The recess 531 of cylinder 529 cooperates with an annular projection 527A on the cursor 527, in such a way that when the device 513 is axially inserted into the cylinder space of the needles, the cursor 527 is locked because of the recess 531 cooperating with the projection 527A, while the grooved roller 519 carrying the holding hooks 521 has an upward stroke. This determines the relative sliding between cursor 527 and holding hooks 521 and therefore the outward oscillation of holding hooks due to the cam profile 525. A collar 533 coupled with the stanchion 517 and equipped with an elastic recess 535 cooperating with the lower surface of the cursor 527 blocks with a damping effect the upwards stroke of the pick-up device 513 in a suitable position as described hereinafter.

FIGS. 23-28 illustrate the operating cycle leading to the pick-up of the tubular knit product M from the circular machine 501 to bring it outside and therefore transfer it toward the flip-over member 515. In particular, FIGS. 23-28 show an axial section of the knitting machine and of the pick-up device. FIGS. 23-27 are to be read with figures of the same number and a letter attached thereto, which provide enlarged details of knitting members of the knitting machine and of holding hooks 521 that execute the pick-up of the tubular product.

In FIG. 23 there is shown the final step of the knitting cycle of the tubular knit product M that is stretched inside the aspirating tubular member 511. In the arrangement of FIG. 23 the tubular product is engaged with the machine hooks 509 of the dial 505. Therefore, the product in this step has already been discharged from the needles of the circular machine, which can start a new forming cycle of the next knit tubular product.

In FIG. 24, inside of the tubular member 511, there has been inserted the pick-up device 513 having an upward stroke. The tubular knit product M is sucked inside the vacuum volume of the pick-up device 513. Because of the above described above operation and as disclosed in particular in FIGS. 22A-22B, when the pick-up device 513 has attained the position of FIG. 24, holding hooks 521, disposed in the zone directly below the dial 505, are already radially diverged. The dial 505 has been taken to a raised position in relation to the needles of the circular machine.

In the following step (FIGS. 25, 25A) the dial 505 is falling inwardly to bring the machine hooks 509 of the dial to the same level as the upper ends 521A of the holding hooks 521. Accordingly, as shown in detail in FIG. 25A, each holding hook 521 engages with the upper end 521B a corresponding anchored part of the knit fabric on the corresponding machine hook 509 of the dial 505.

In the following step (FIG. 26, FIG. 26A), the machine hooks 509 of the dial 505 are re-drawn. In this way the knit tubular product, released from the knitting members of the circular machine, is engaged with loops to the holding hooks 521 of the pick-up device 513.

In the following step (FIGS. 27, 27A), the pick-up device 513 is lowered and axially removed by the sucking tubular member 511. This lowering movement causes the radial retraction of the holding hooks, namely holding hooks 521 oscillate towards the axis of the pick-up device 513 due to a ceasing of the action of the pushing of the cam profile 525.

In FIG. 28 there is shown the pick-up device 513 completely removed from the circular machine and from the draft tube 511. In the following step the pick-up device 513 is shown transferred, with a side stroke, below dumper member 515, so that elements 513 and 515 assume the reciprocal position shown in FIGS. 28 and 29.

The structure of the dumper member 515 is shown in FIG. 29, which shows a circular arrangement of harpoons 541. Each spike 541 is equipped with a small pole 543. The jackstraws 543 are simultaneously operated from a common cam that acts on heels 543A of the jackstraws themselves. The jackstraws 543 cooperate with the harpoons 541 for blocking them, when the tubular knit product M is moved by the pick-up device 513. The rim of harpoons 541 (of which in the figures for representative simplicity just two diametrically opposed harpoons are drawn) is divided in two semi-arches separated by a vertical plane containing the axis B-B of the dumper member 515, namely an orthogonal plane to the plane of FIG. 29. The two semi-arches of harpoons 541 are brought by two portions 545A, 545B, in which the harpoon support is subdivided and by the respective jackstraws 541, 543. The two portions 545A, 545B are hinged one to the other around to a substantially diametrical axis, which is substantially horizontal C-C in relation to the axis B-B.

Over the rim of harpoons 541 and of the respective jackstraws 543 carried by the portions 545A, 545B is a double aspirating system, consisting of a first aspirating duct 547 and of a second aspirating duct 549 coaxial to duct 547. The two aspirators 547 and 549 have the function to direct the tubular knit product M respectively before and after the seam of the toe, as will be described with reference to FIGS. 29-40. In particular, FIGS. 30A-38A provide details of the dumper member during the operative cycle shown in FIGS. 29-40.

The sequence of operations performed by the pick-up device 513 in combination with the flip-over member 515 and with the sewing machine 517 is described hereinafter.

In FIG. 29, the pick-up device 513 is below dumper member 515 with holding hooks 521 in radially positioned retreats. Below of the dumper member 515 a substantially cylindrical member 550 is placed that forms a recess 551 for the cursor 527, whose function is substantially equivalent to the function of the recess formed in the member 529. With the upwards movement of the pick-up device 513, the latter comes through the cylindrical member 550 until the annular projection 527A of the cursor 527 comes into contact with the recess 551. The additional turn of the pick-up device 513 upwards causes the radial enlarging of holding hooks 521, which carry the row of stitches engaged to them towards the harpoons 541. In FIGS. 30 and 30A there is shown the step, in which the pick-up device 513 has moved across the cylinder member 550 and has been brought almost to the level of the rim of harpoons 541, while holding hooks 521 are still in radially positioned re-treats. In the following step (FIGS. 31, 31A) the above mentioned additional turn causes the radial enlarging of holding hooks 521 by causing oscillation of the same around the oscillation points 523, such that the stitches engaged by holding hooks 521 are brought in a position corresponding to the lower end of harpoons 541.

In the following step (FIGS. 32 and 32A) the jackstraws 543 are lowered that block the knitted fabric between the lower extremities 541A (FIG. 32A) of the respective harpoons 541 and the jackstraws 543.

In the following step (FIGS. 33, 33A) the aspirators across the external sucking duct 547 are activated, causing the pneumatic retention of the part of tubular knit product M that is found below the rim of harpoons 541.

In the following step (FIGS. 34, 34A), while the aspirators across the duct 547 are still active, the lowering of the pick-up device 513 is started with consequent radial retraction of holding hooks 521 and reversal of the product. This causes a release of the fabric (see FIG. 34A) that remains engaged to the harpoons 541, between the lower extremities 541A and the respective jackstraws 543. In FIG. 35 the pick-up device 513 has been completely moved away from the flip-over member 515 and return toward the knitting machine to receive the following product.

In the following step (FIGS. 36, 36A), the portion 545A of the support of the rim of harpoons 541 and related jackstraws 543 rotate by 180° around the diametrical axis C-C, bringing the semi-arc of harpoons 541 supported by the portion 545A in a position opposite to the harpoons of the portions 545B.

With this arrangement, a sewing machine 517 can apply the seam that is looping connecting the opposite stitches of each couple of harpoons, as shown in FIGS. 37 and 37A. In FIG. 38, 38A there s shown the following step, in which the jackstraws 543 open to free the fabric at the toe now seamed. In FIG. 39 the fabric has been freed and in FIG. 40 there is shown that, activating the aspirators across the central aspirator duct 549, the closed toe P of the tubular knit product M is sucked inside the sucking duct 549 with a new, consequent straightening of the product that carries the seam just performed inside the same product. Continuing aspiration, the product M is completely straightened and is sucked inside the pneumatic duct 549 that carries it in a collection, treatment or packaging area.

The double operated reversal by means of the aspiration ducts 547,549, allows carrying out the seam on the internal side of the product M, in such a way that the seam itself does not appears visible when the product is worn. In this embodiment, in which the overturning of two flaps of the toe to be sewn is done by a member different from the pick-up device of the product from the cylinder of needles, contrarily to the configuration illustrated in FIG. 1 with 20, dumper member 515 allows a release of the pick-up of the product as regards sewing.

Although the embodiment depicted in FIGS. 21-40 provides a series of advantages, among them a particular accuracy in the control of the fabric, the transfer may be carried out in a different way, without involving the textile members of the dial. FIGS. 41, 41A, 42, 42A show a transfer of the textile tubular product from the needles of the circular machine to the hooks 521 of the pick-up system of the tubular product. In this embodiment, the transfer is obtained thanks to the elastic characteristics of last knitted rows R of the product. These are held by the needles 503 after the hooks 521 have been placed in lifted and wide apart arrangement, as shown in FIGS. 41 and 41A. In these figures it is to be observed that the upper limbs of hooks 521 are extended to the last rank of stitches just discharged from the needles 503. The tubular product is tensioned elastically. When the needles 503 are lowered, the last row of stitches is freed and the elastic thread clasps around the upper ends of hooks 521, as shown in FIGS. 42, 42A. From this arrangement, the product is manipulated as already described with reference to FIG. 27 and the following figures.

The mode of engagement of the tubular product to the hooks of the pick-up device illustrated in FIGS. 41, 42 can be provided also in a system as shown in the FIGS. 1-21.

It is to be understood that the description and drawings provided herein relate only to preferred embodiments of the invention, which can vary in forms and structures while remaining within the scope and spirit of the invention.

BRIEF DESCRIPTION OF DRAWINGS

The above described and additional advantages and features of the present invention will be better understood by referring to the enclosed drawings of embodiments of the invention, in which.

Figure 1:
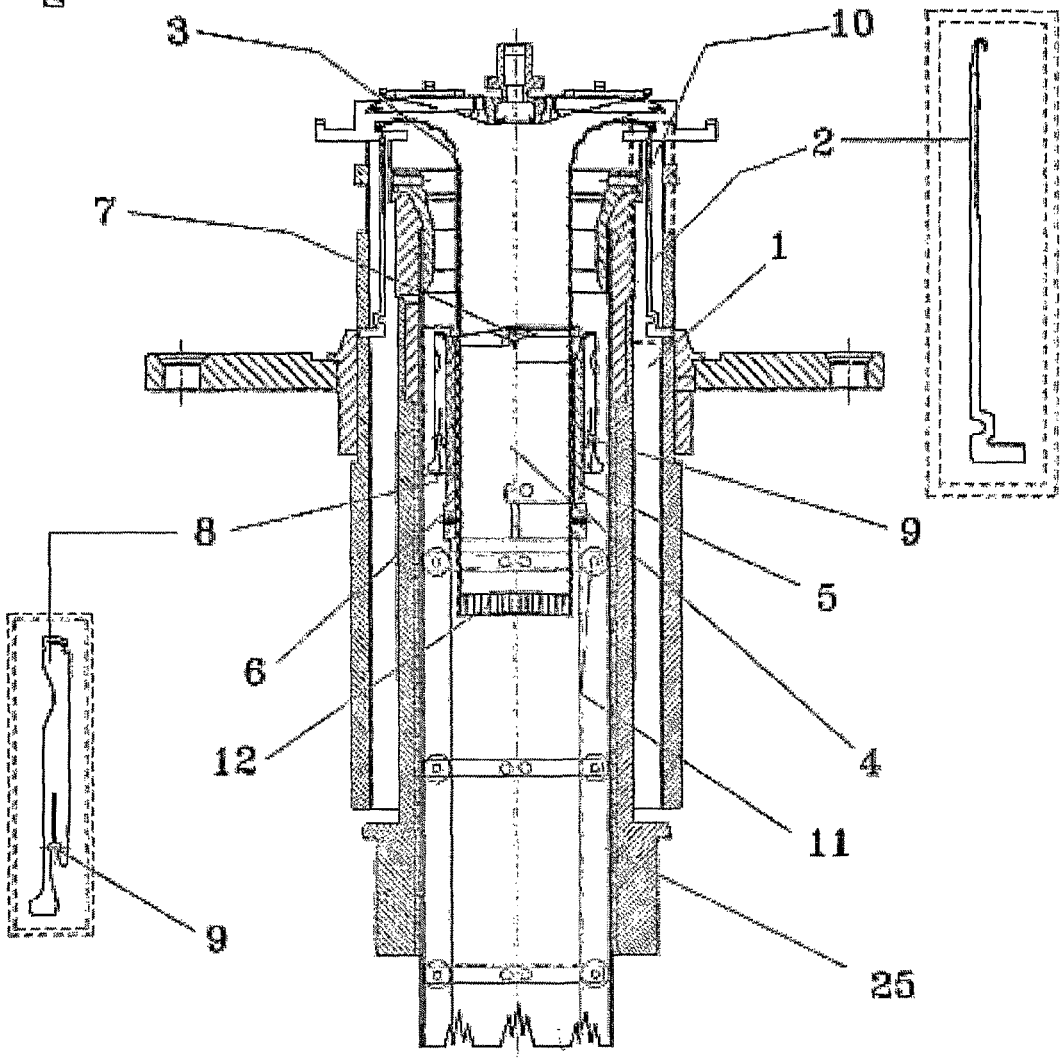
FIG. 1 shows a longitudinal section of a circular machine with a pick-up device of the inserted tubular knit product in the cylinder of needles, in a first embodiment of the invention.
Figure 2:
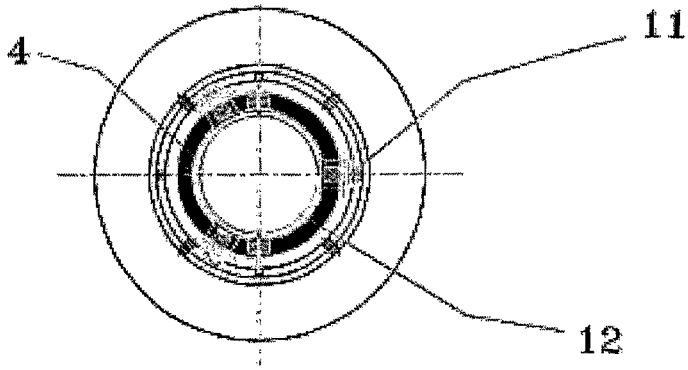
FIG. 2 shows a cross section of the embodiment of FIG. 1.
Figure 3:
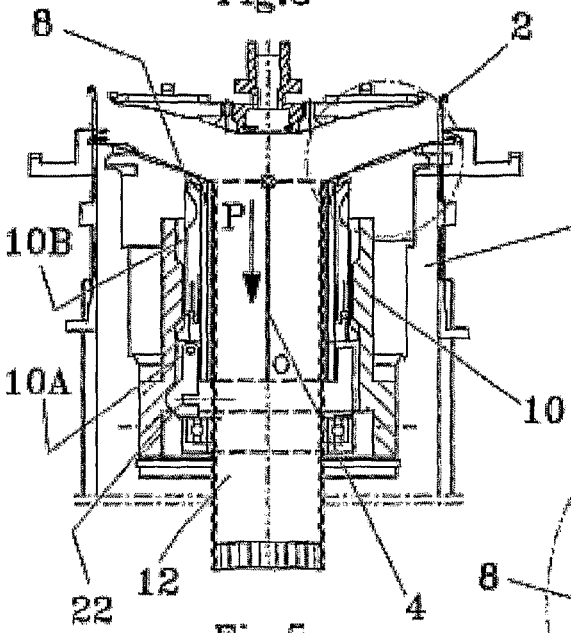
FIG. 3 shows a longitudinal section similar to the section of FIG. 1 in a following operating step.
Figure 4:
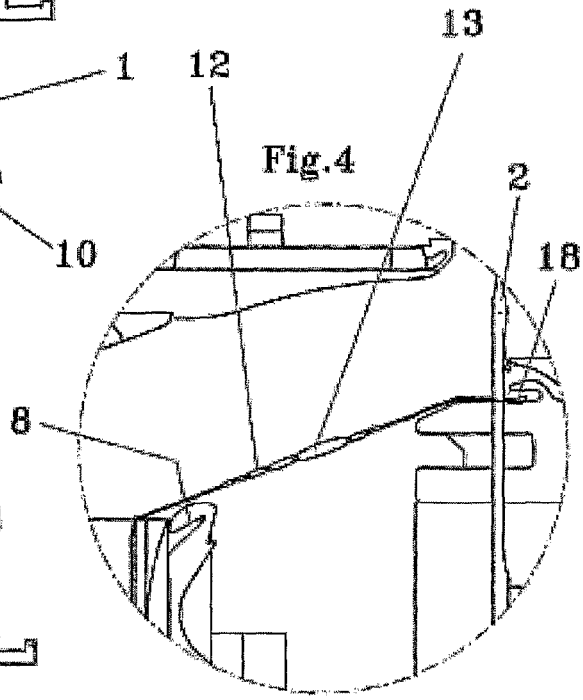
FIG. 4 shows an enlargement of the stitch forming zone in the arrangement of FIG. 3.
Figure 5:
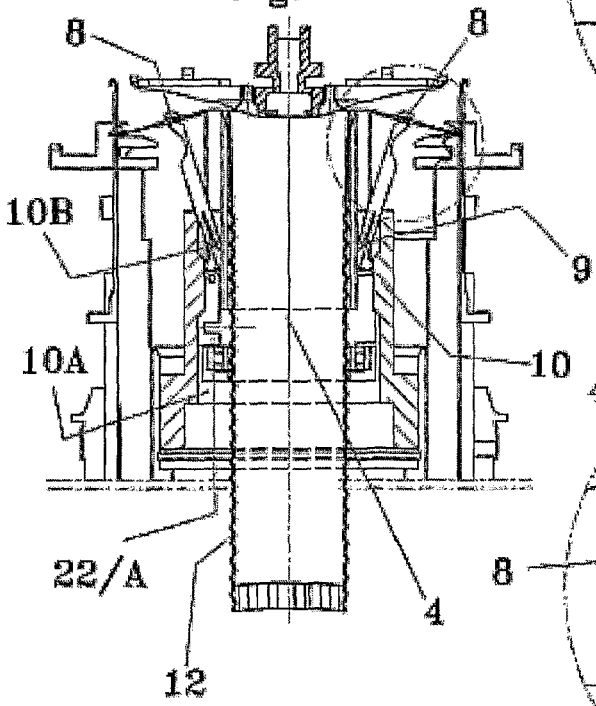
FIG. 5 shows a longitudinal section similar to the section of FIG. 3 in a later operating step.
Figure 6:
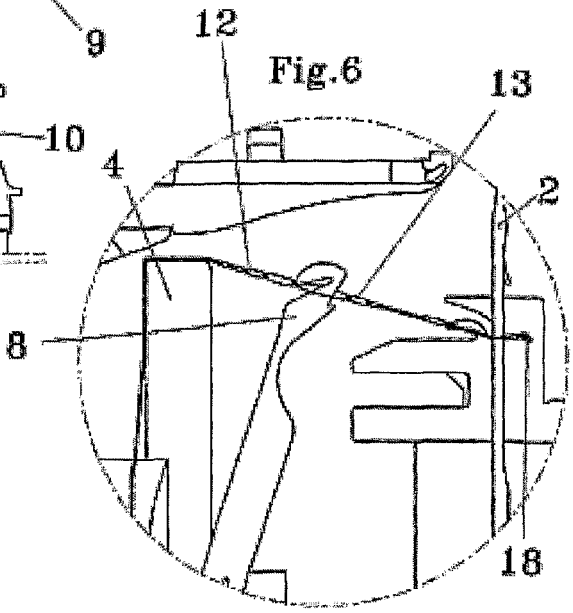
FIG. 6 shows an enlargement of the embodiment of FIG. 5 in the region of engagement of the product from hooks of the pick-up device.
Figure 7:
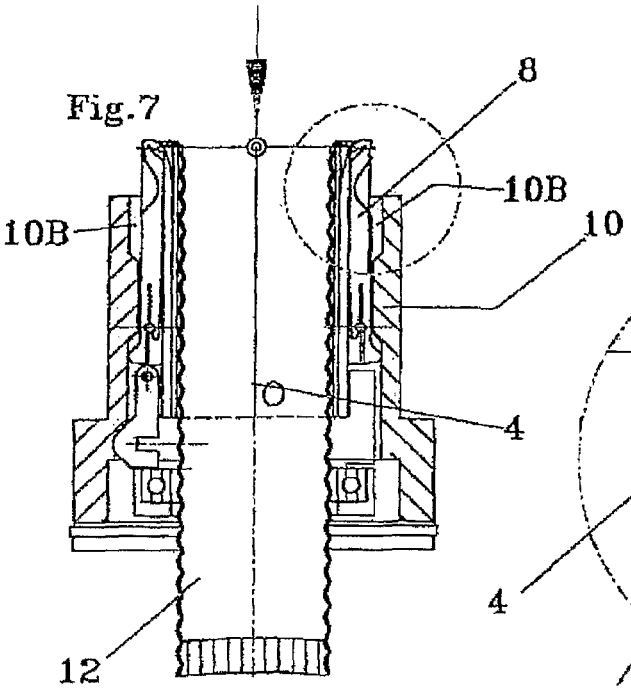
FIG. 7 shows a longitudinal section of the pick-up device in the closing step of the holding hooks.
Figure 8:
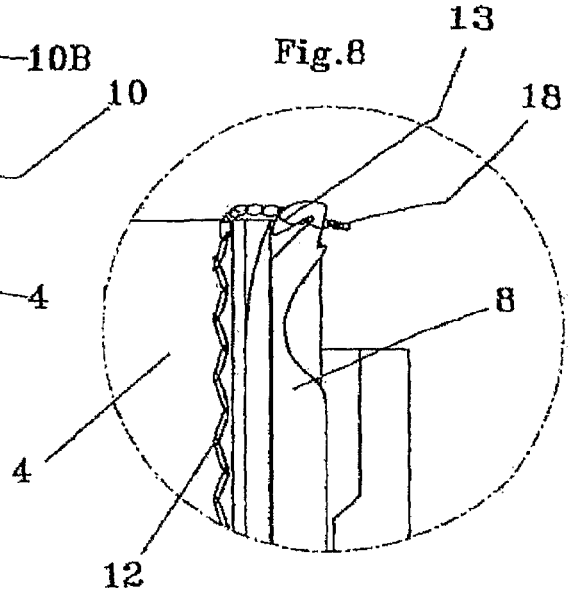
FIG. 8 shows an enlargement of a detail of the FIG. 7.
Figure 9:
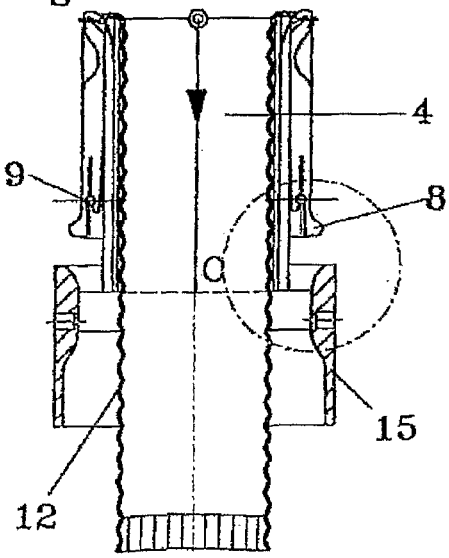
FIG. 9 shows a longitudinal section similar to that of FIG. 7 in a subsequent operation.
Figure 10:
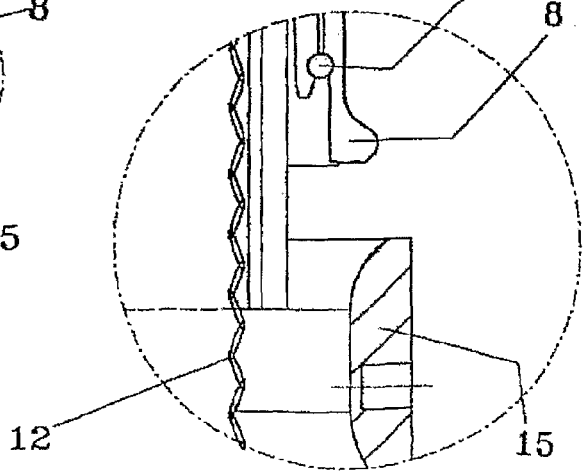
FIG. 10 shows an enlarged detail of the embodiment of FIG. 9.
Figure 11:
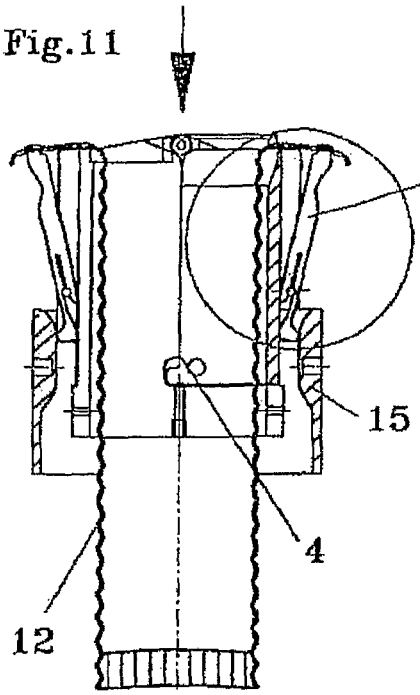
FIG. 11 shows an additional operative step along a longitudinal section of the pick-up device.
Figure 12:
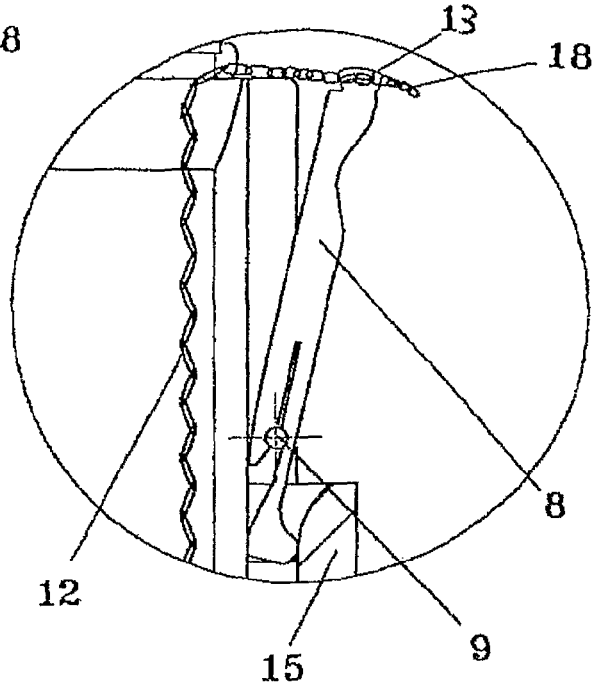
FIG. 12 shows an enlargement of the embodiment of FIG. 11.
Figure 13:
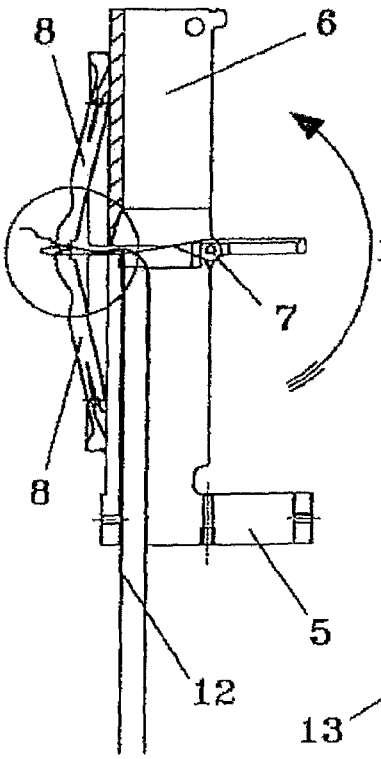
FIG. 13 shows the pick-up device along a longitudinal section after the overturning of one semi-arc of holding hooks onto another.
Figure 14:
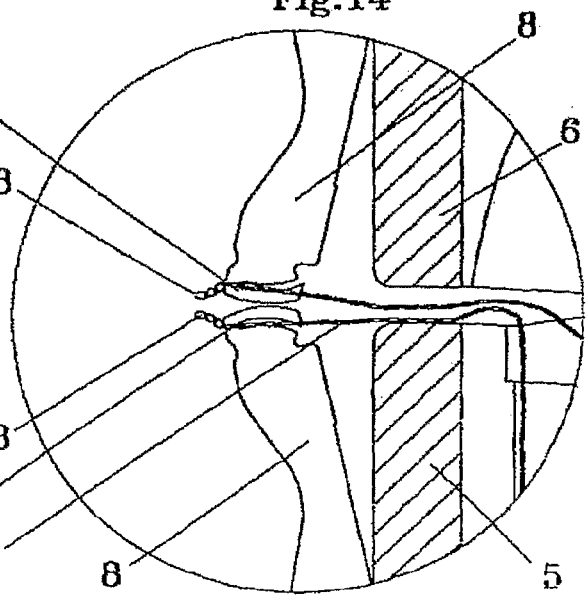
FIG. 14 shows an enlargement of superimposed holding hooks in the arrangement of FIG. 13.
Figure 15:
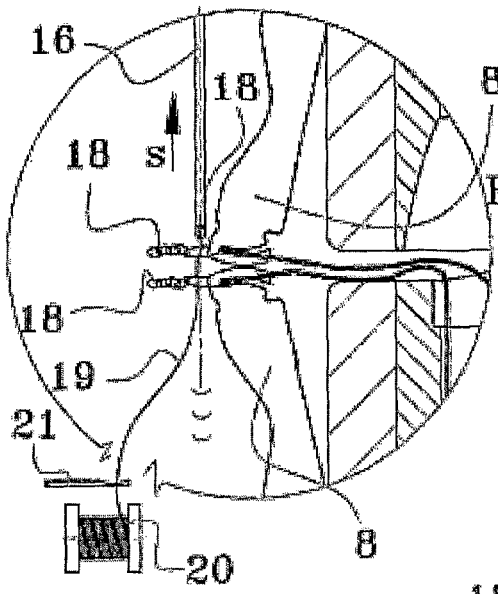
FIGS. 15, 16, 17 and 18 show subsequent sewing steps of the product.
Figure 16:
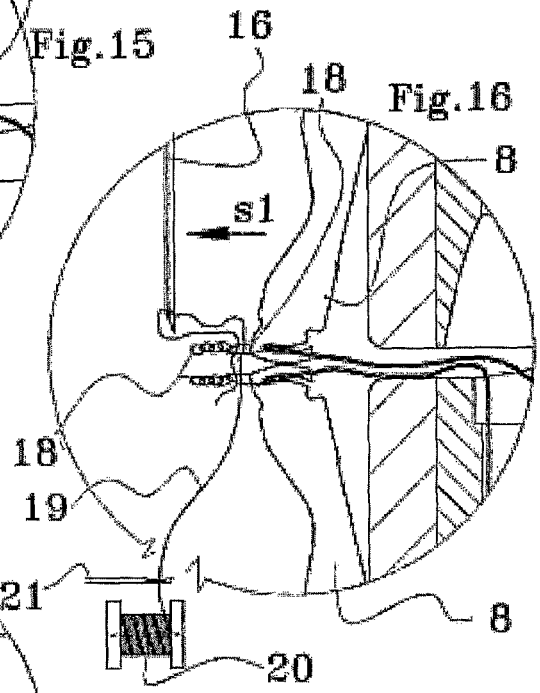
Figure 17:
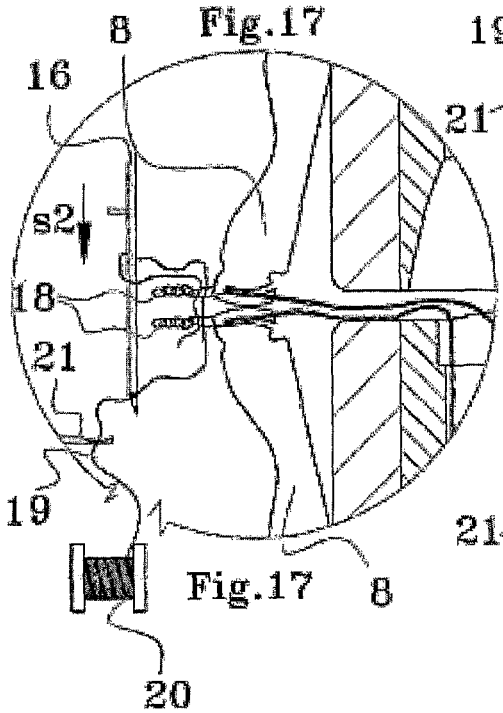
Figure 18:
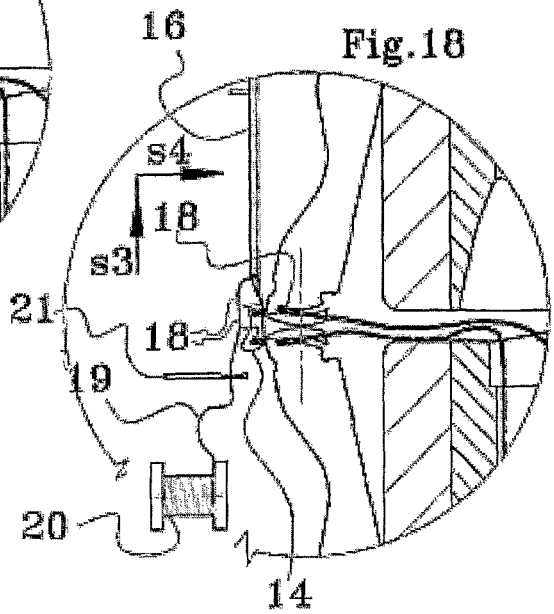
Figure 19:
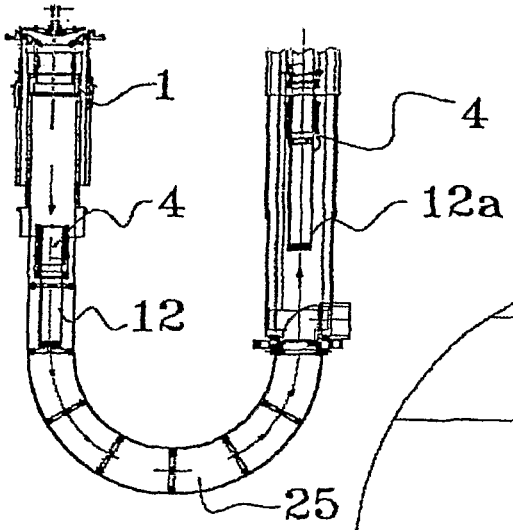
FIG. 19 shows a different embodiment of the invention.
Figure 20:
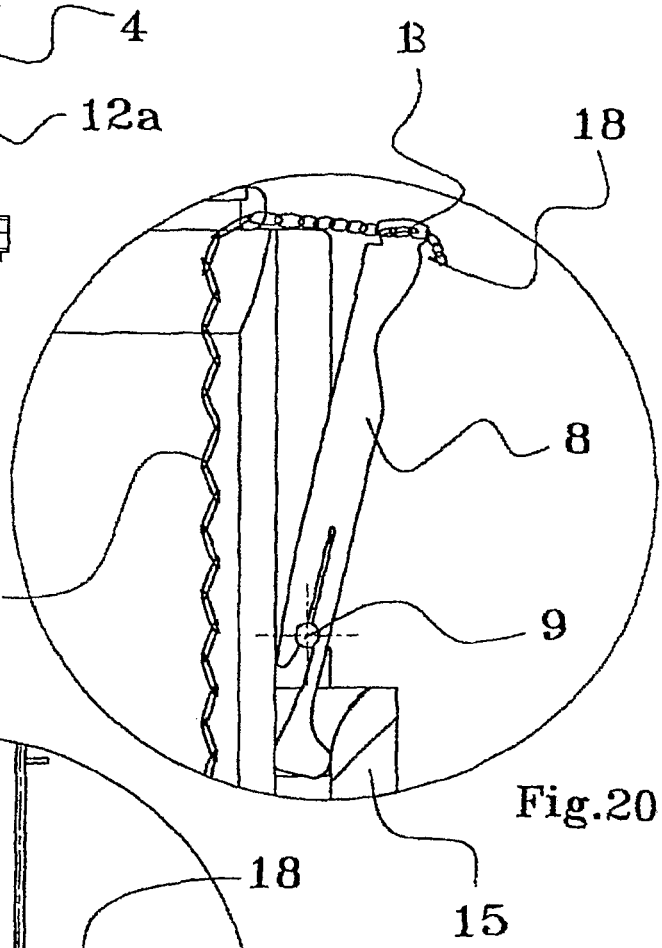
FIGS. 20 and 21 show sewing steps.
Figure 21:
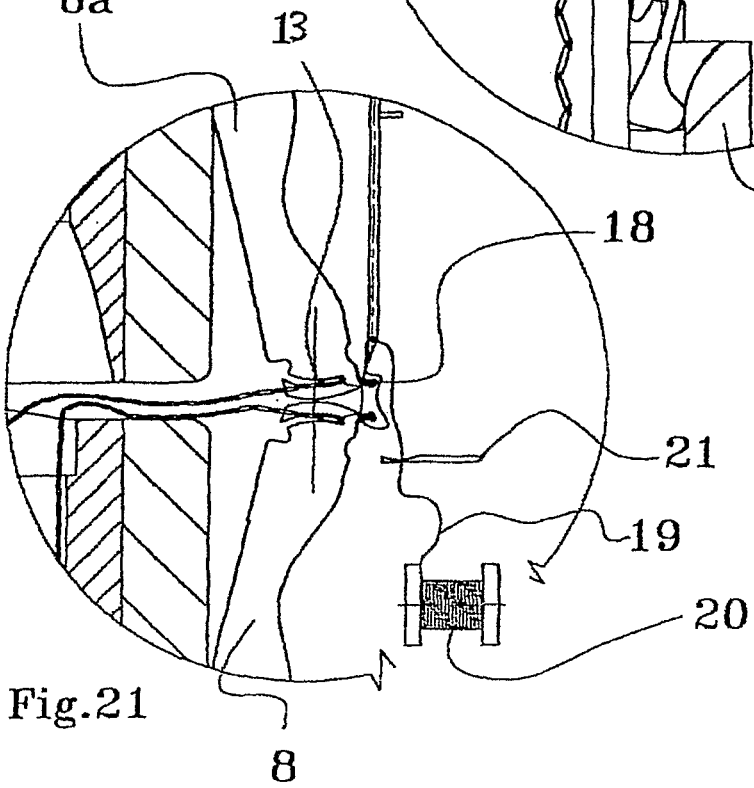
Figure 22:
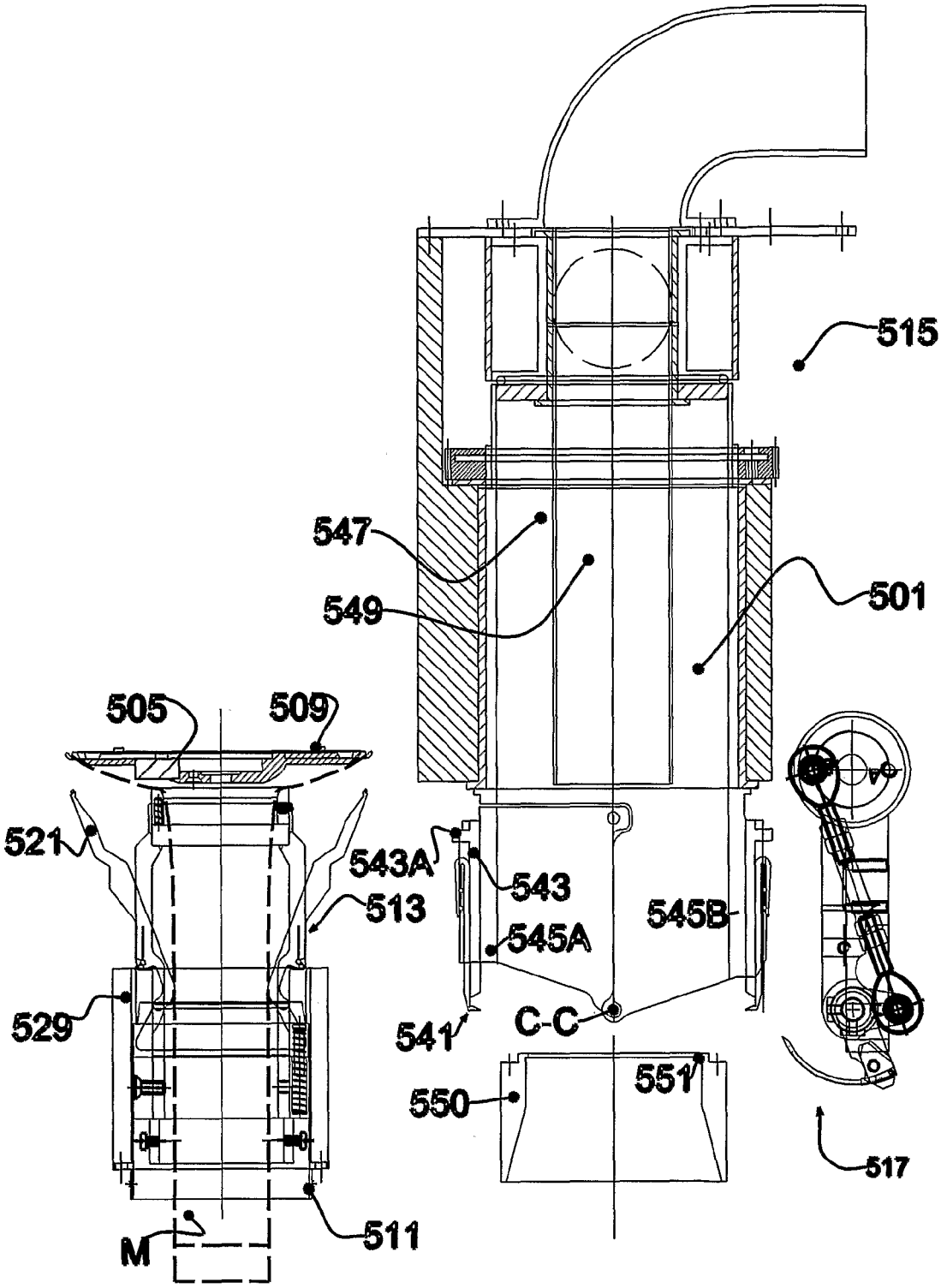
FIGS. 22-40 show, in longitudinal section, a system according to the invention in a different form of execution.
Figure 22A:
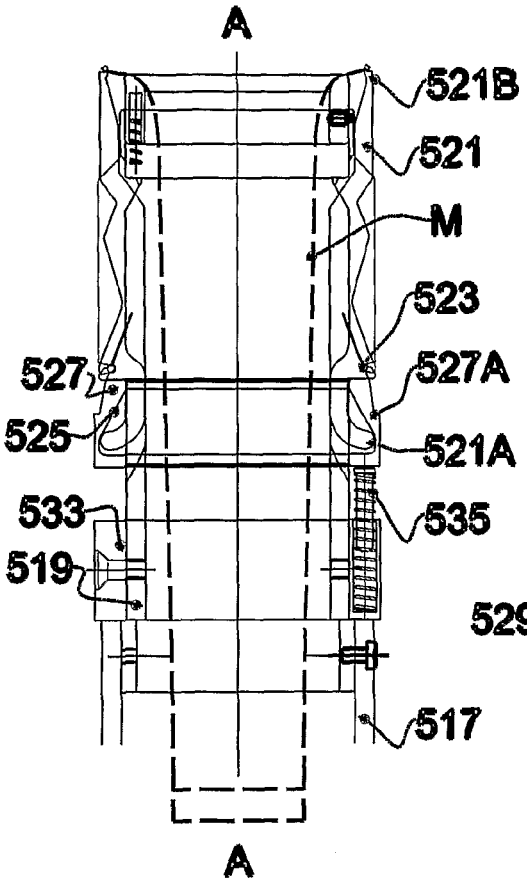
Figure 22B:
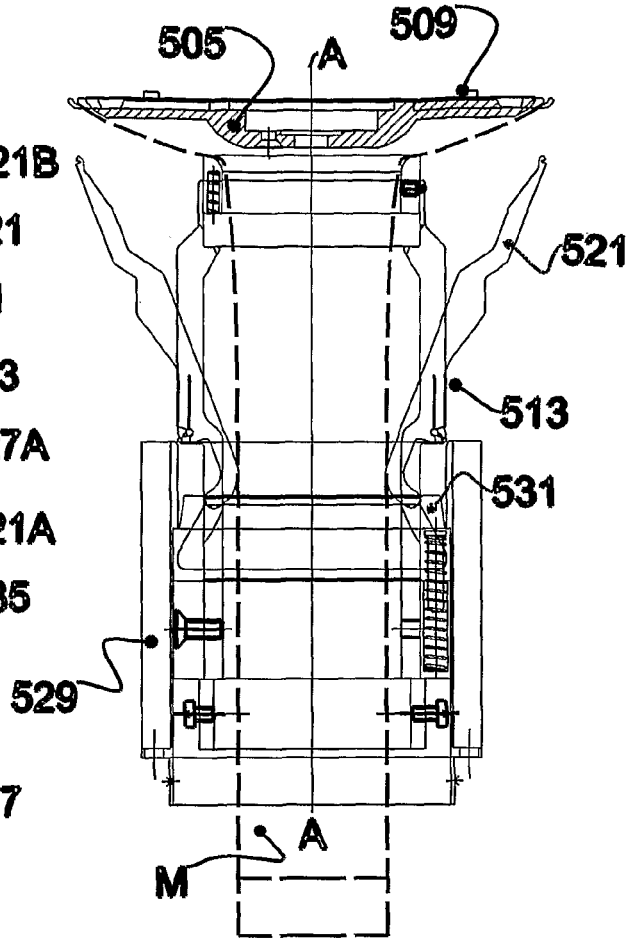
Figure 23:
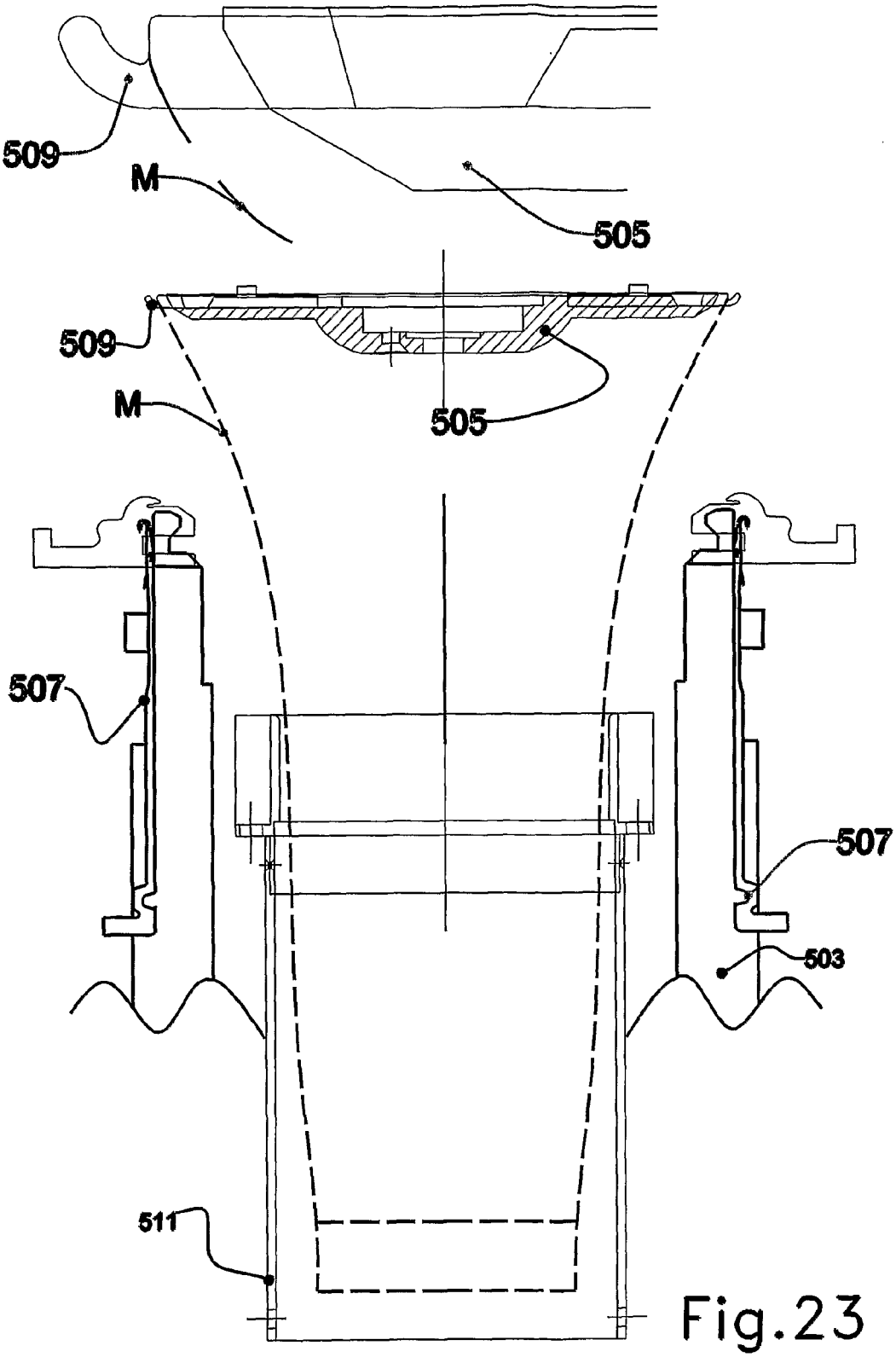
Figures 24, 24A:
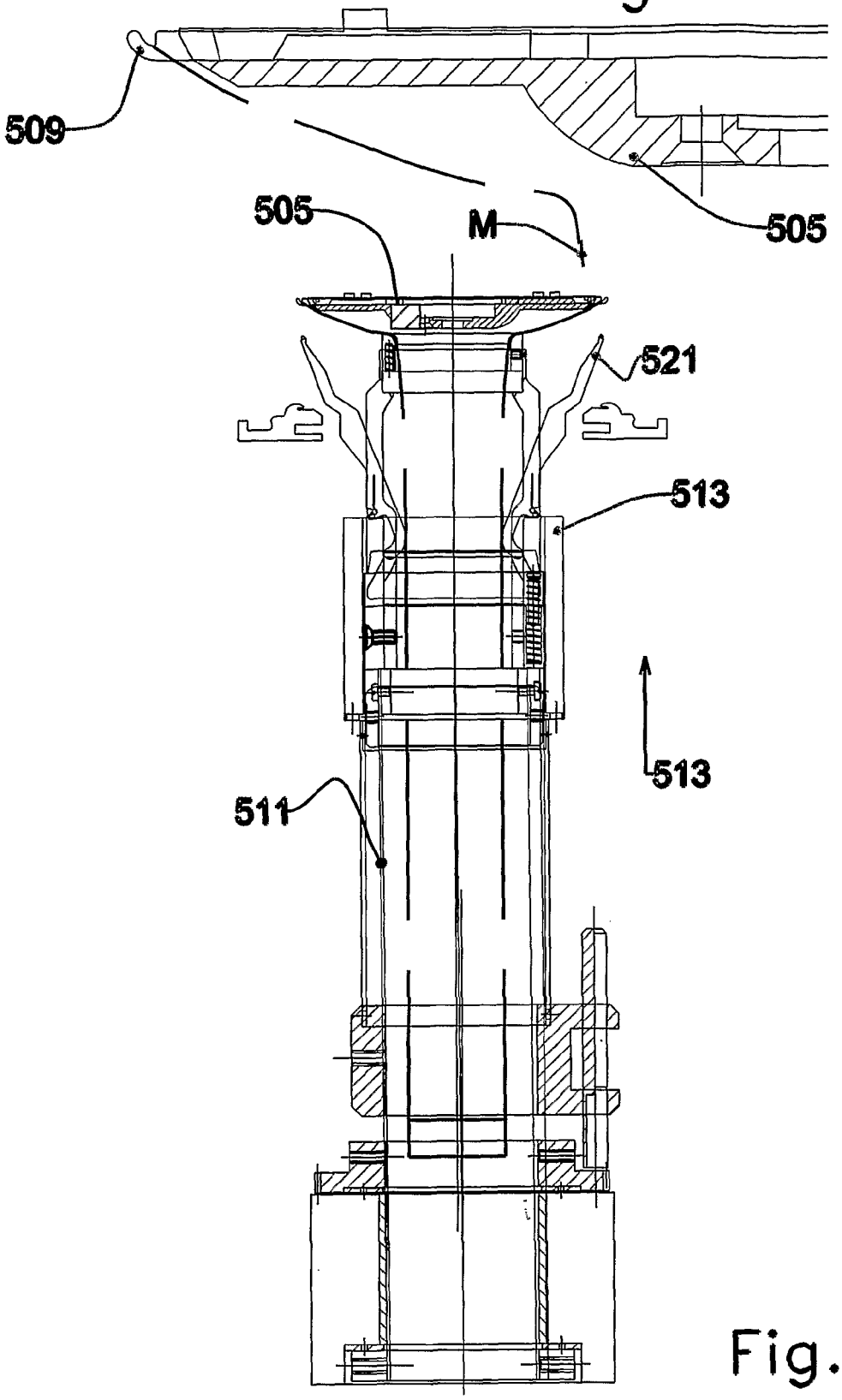
Figure 25A:
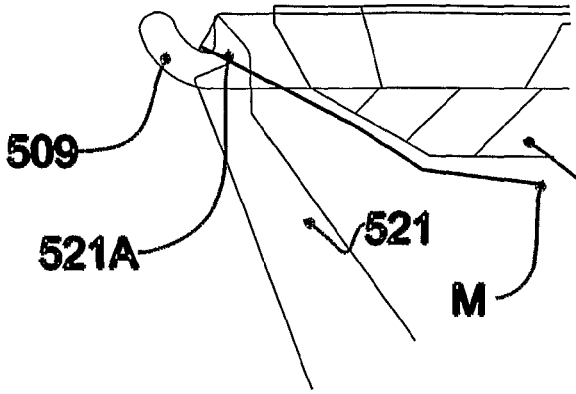
Figure 25:
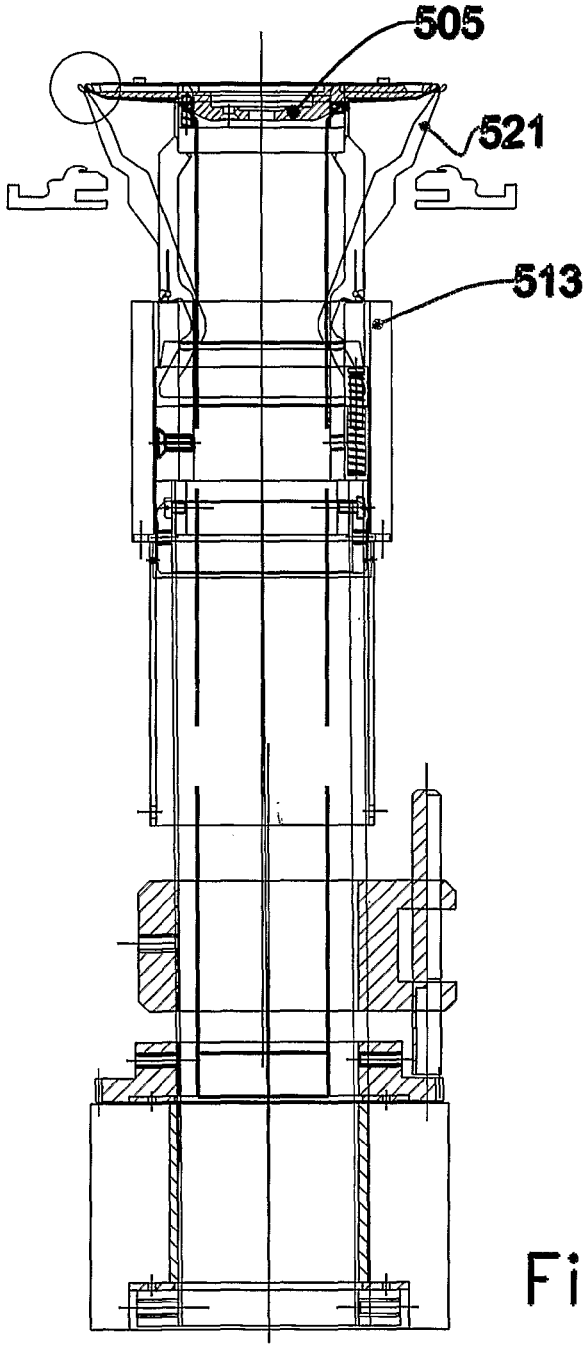
Figure 26A:
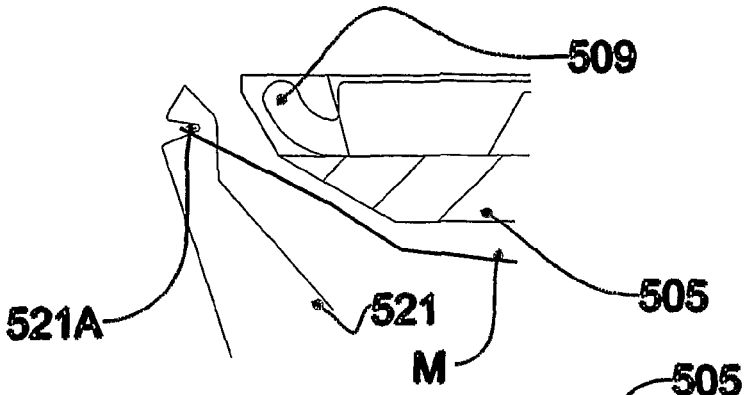
Figure 26:
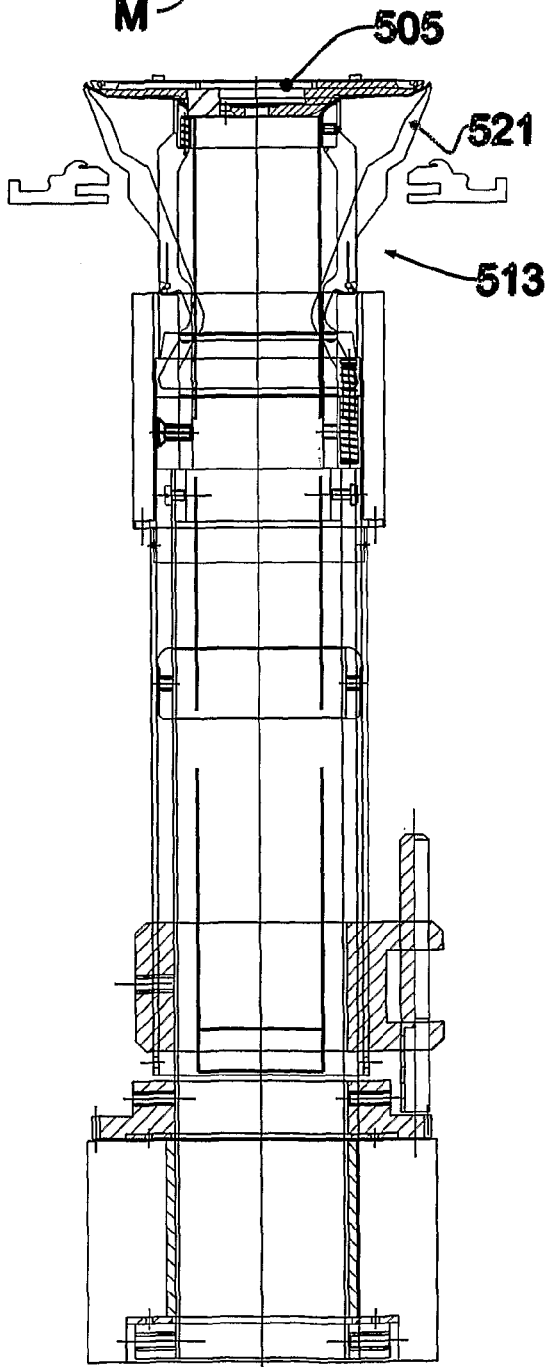
Figures 27, 27A:
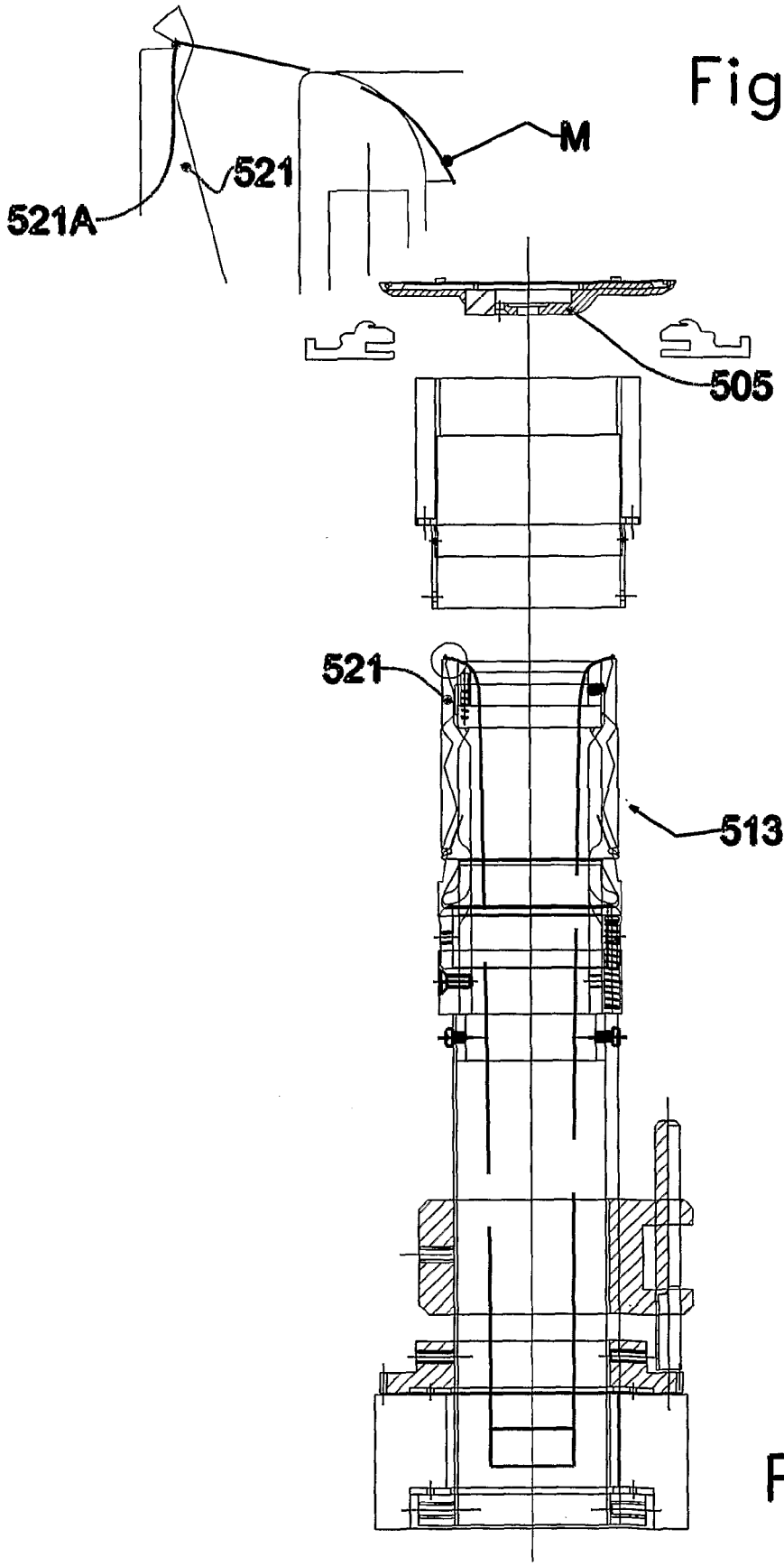
Figure 29:
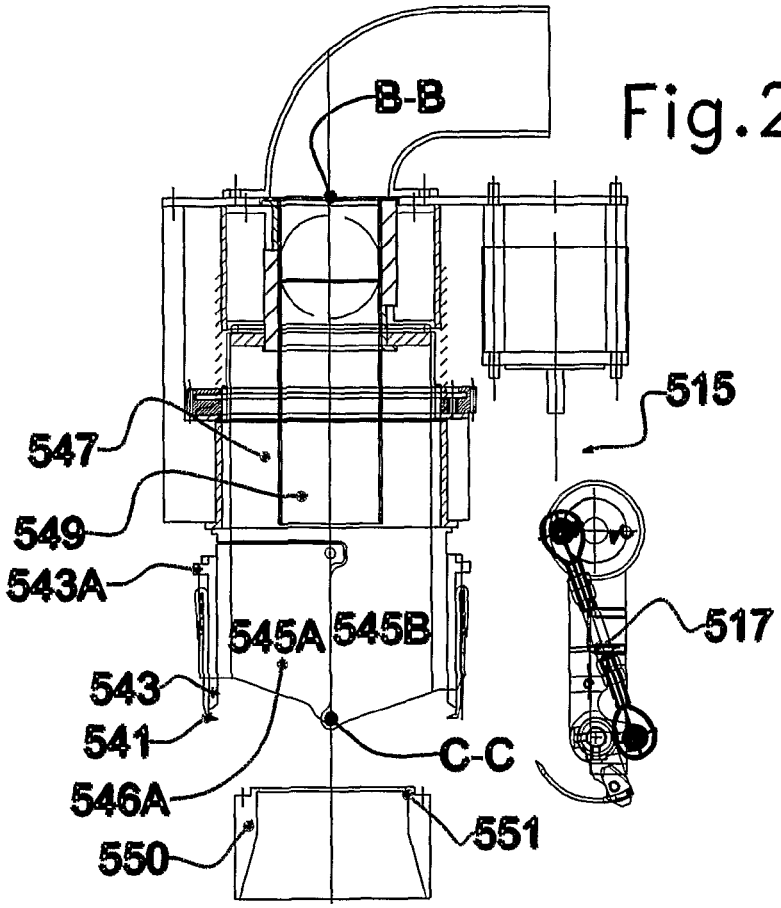
Figure 28:
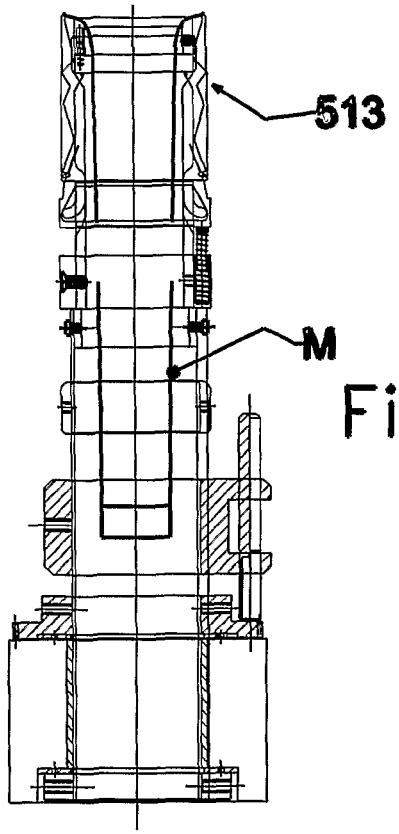
Figures 30, 30A:
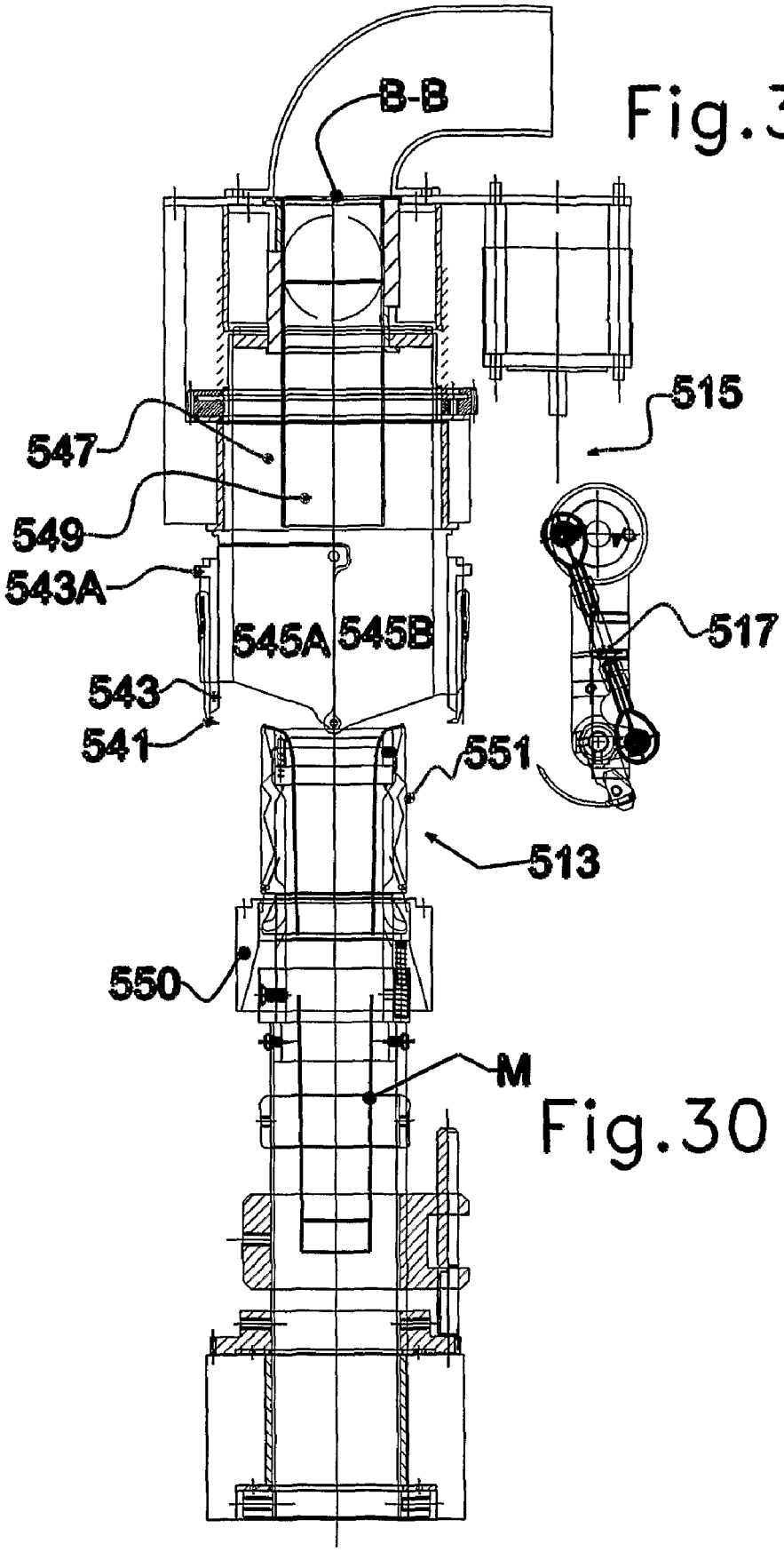
Figure 31:
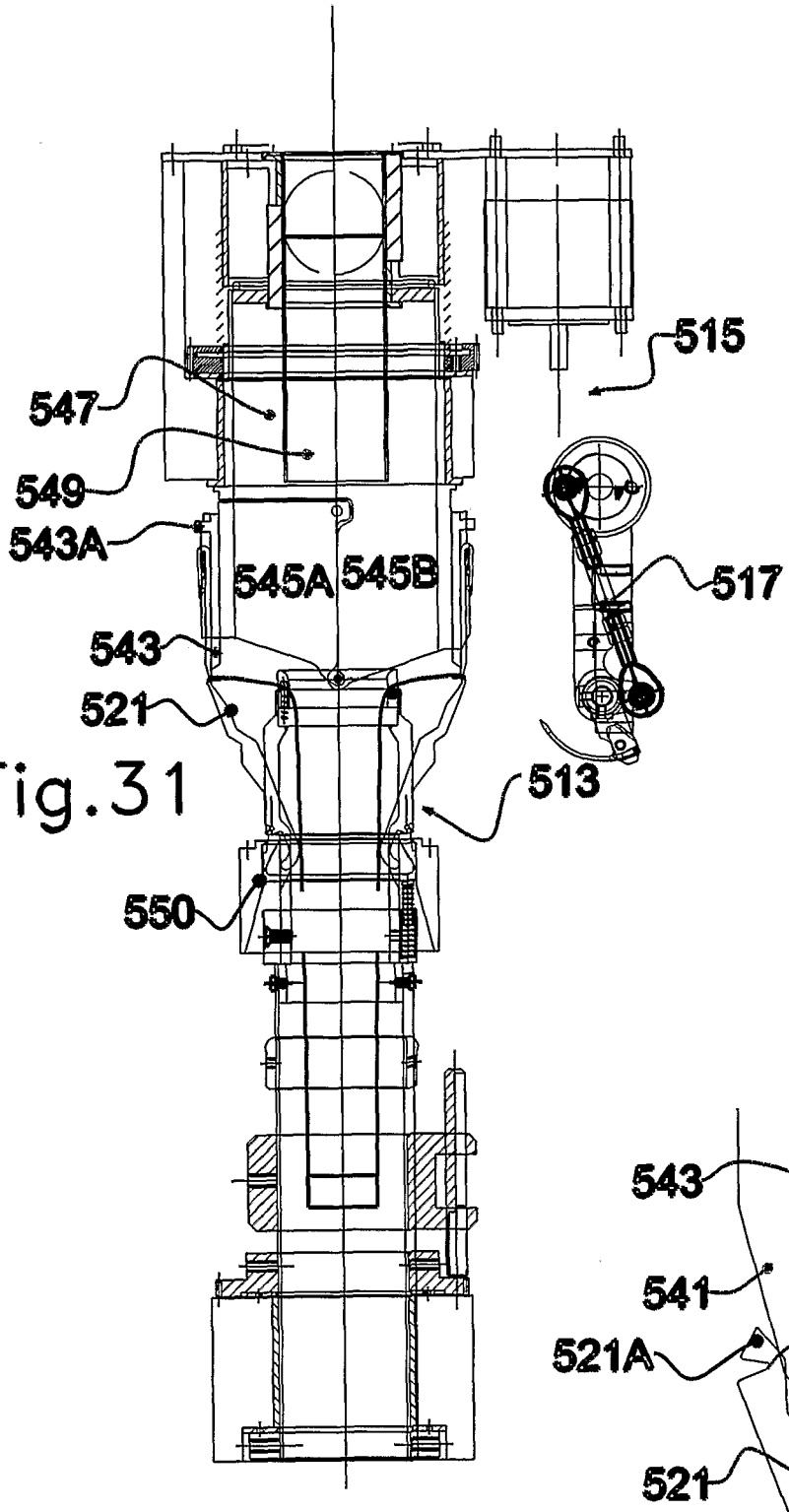
Figure 31A:
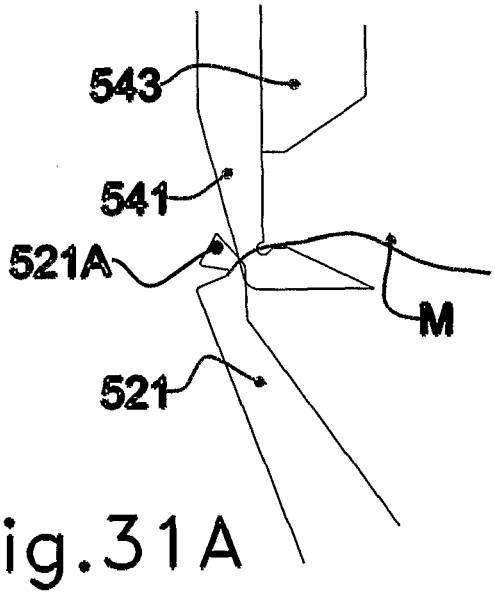
Figure 32:
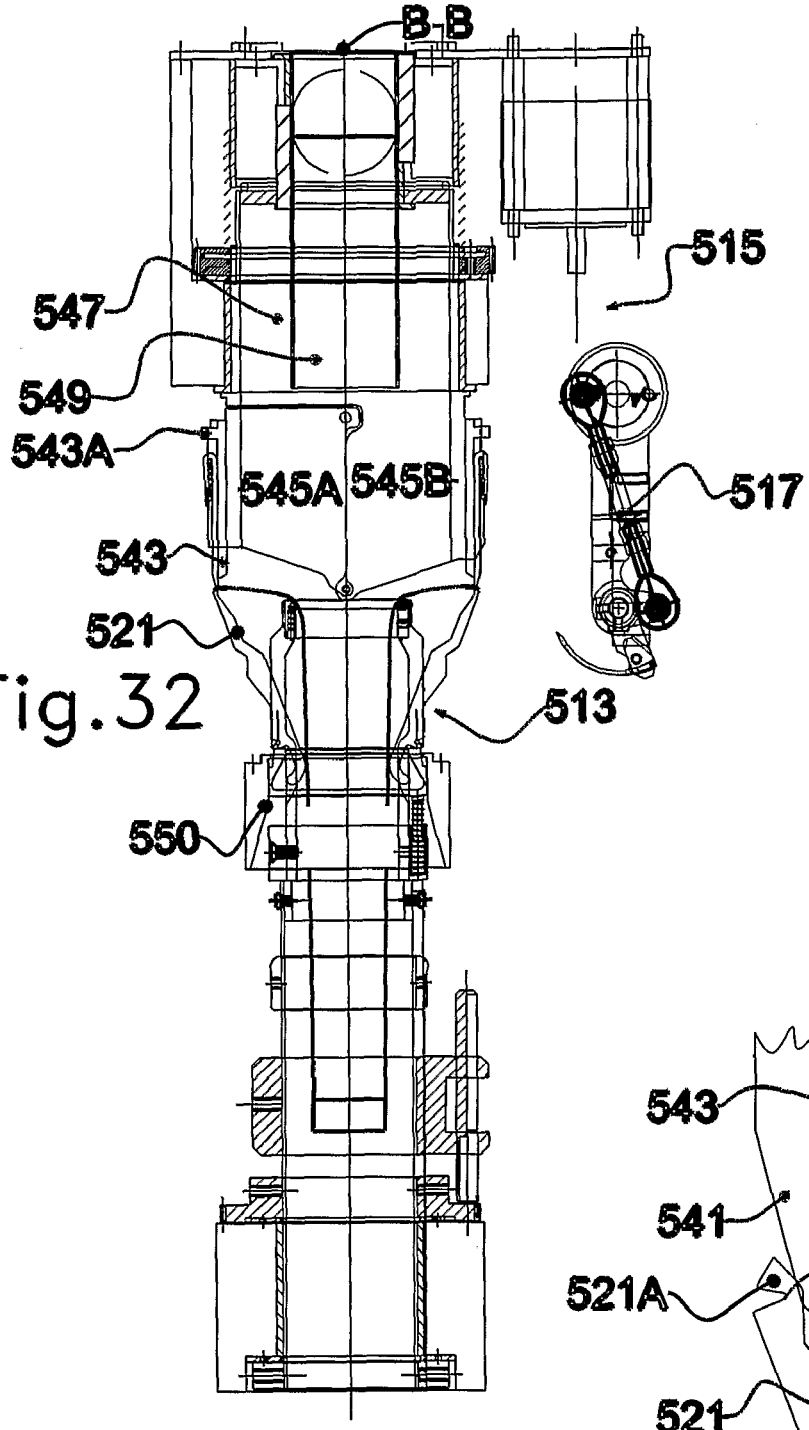
Figure 32A:
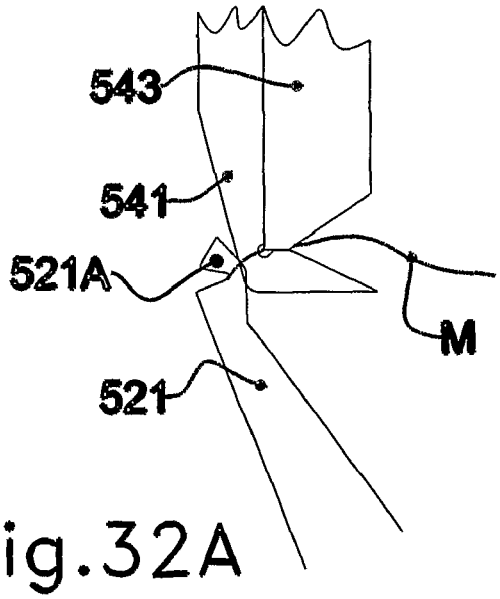
Figure 33A:
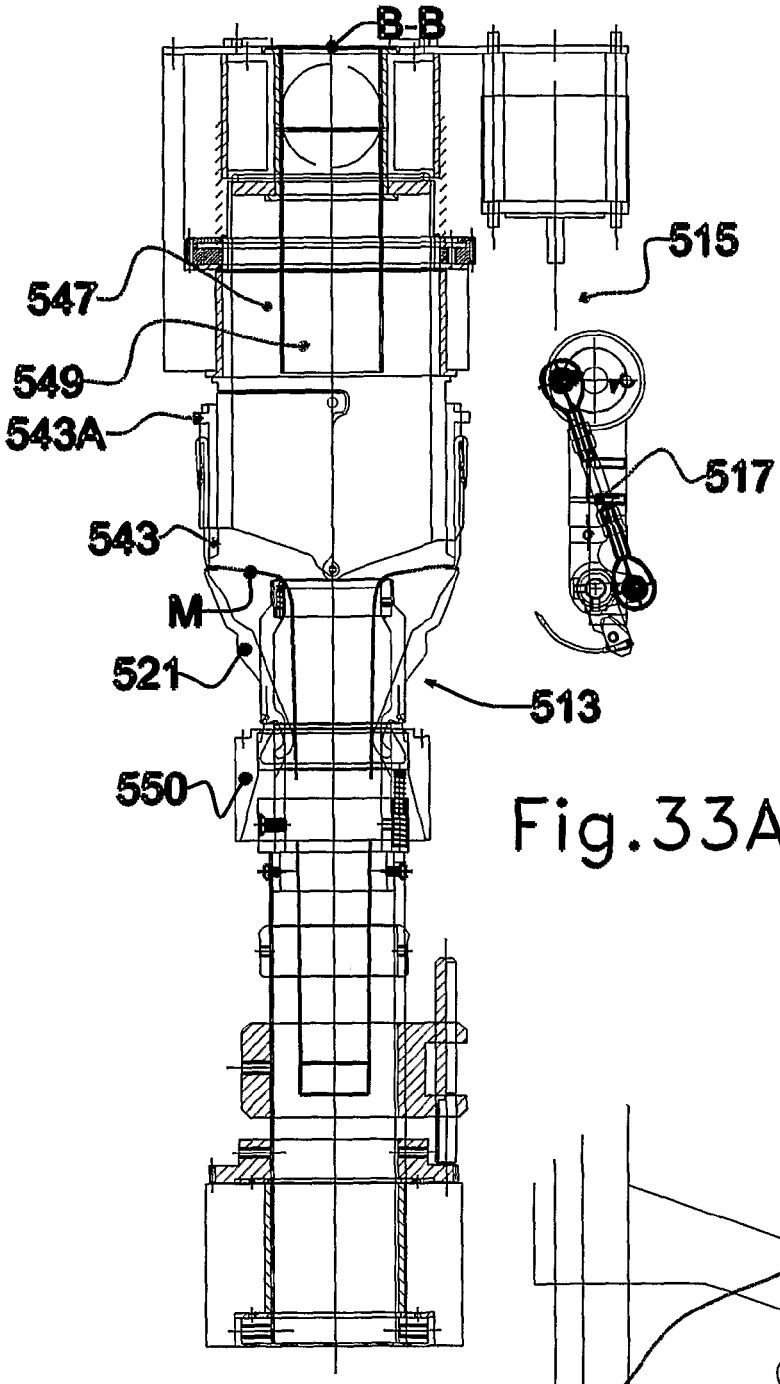
Figure 33:
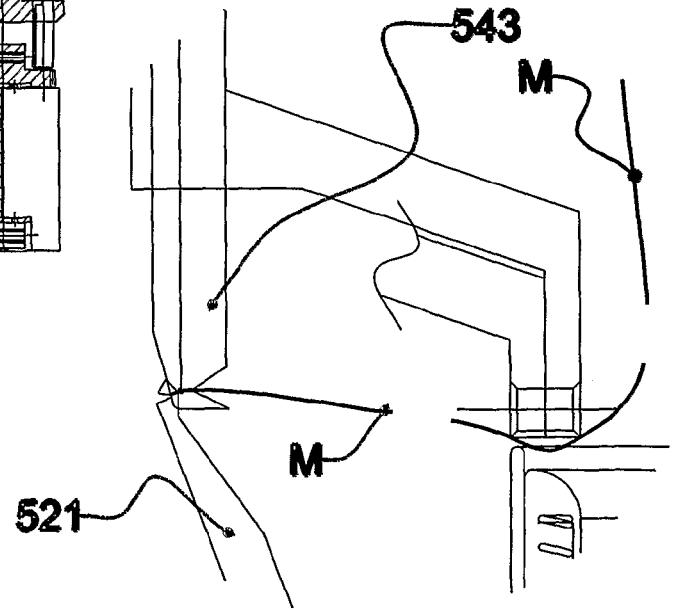
Figure 34A:
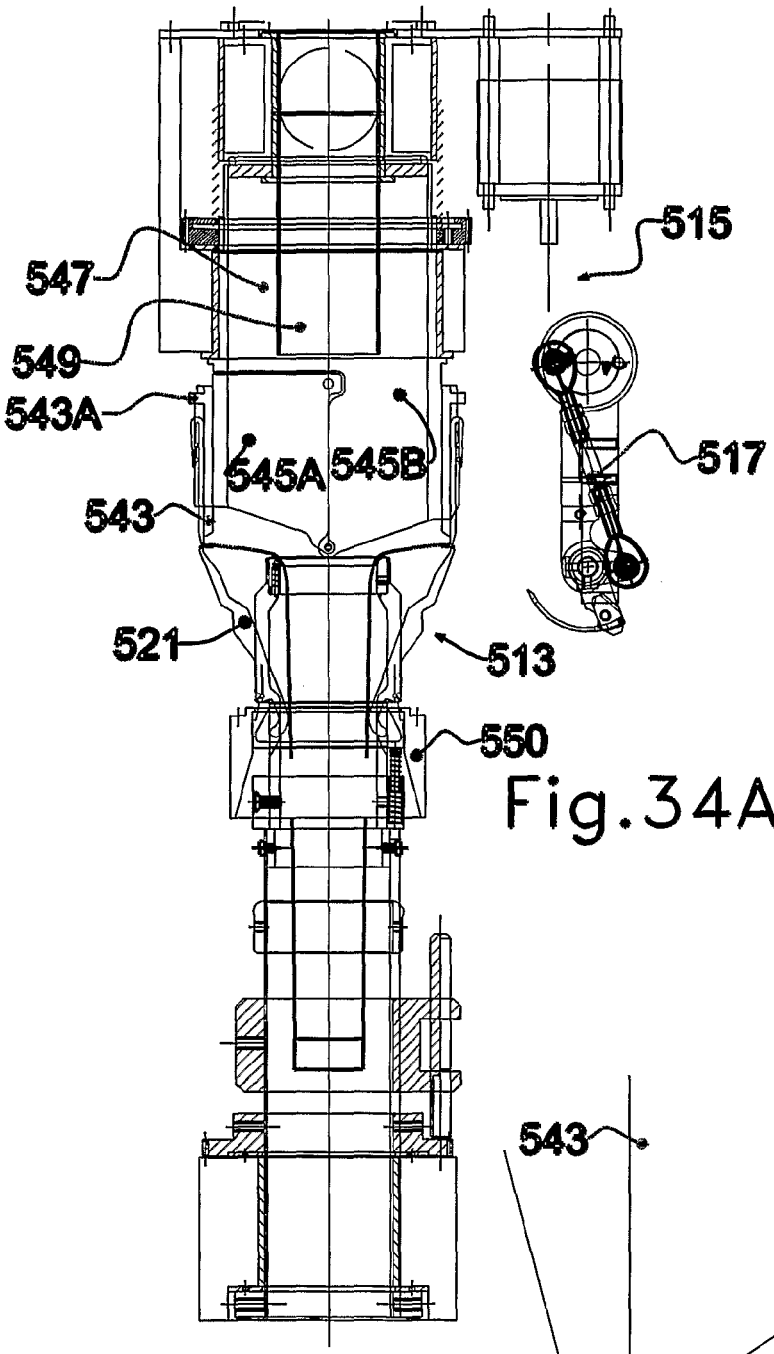
Figure 34:
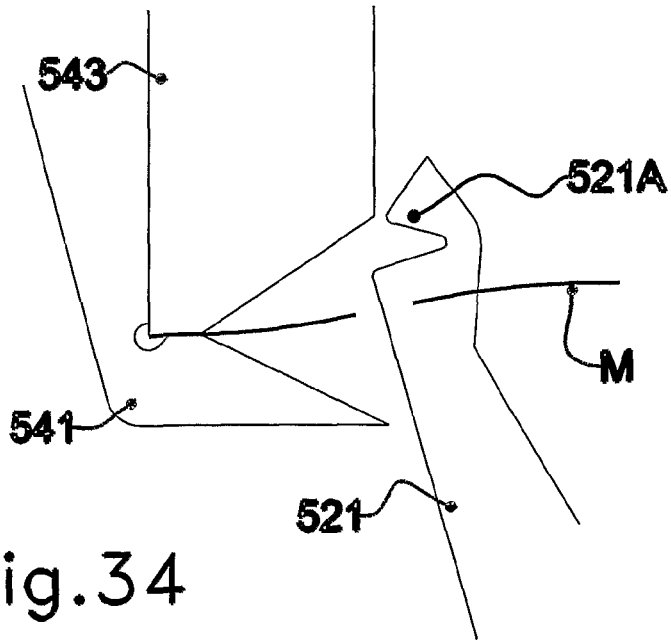
Figures 35, 35A, 36, 36A, 37, 37A:
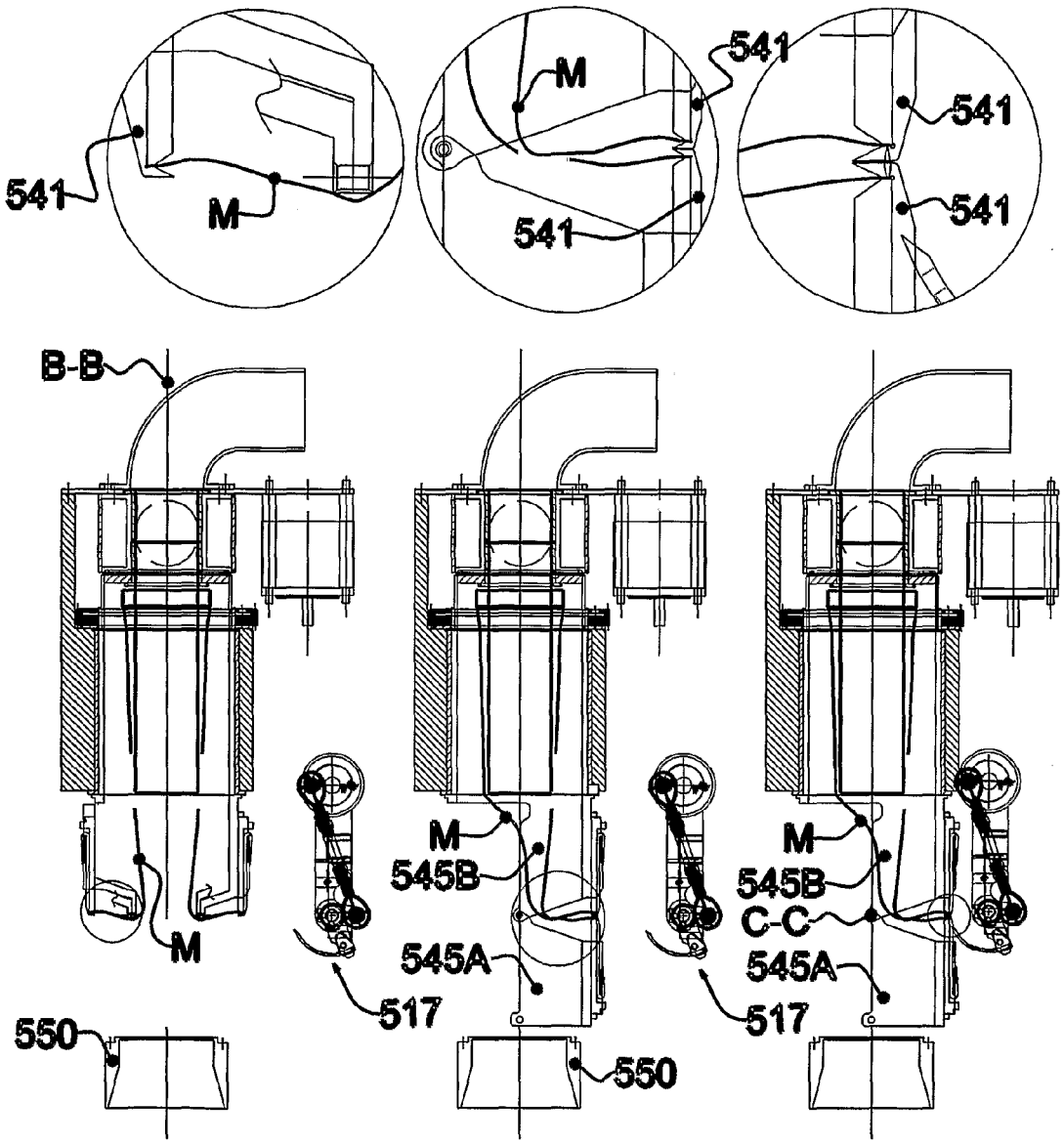
Figure 40:
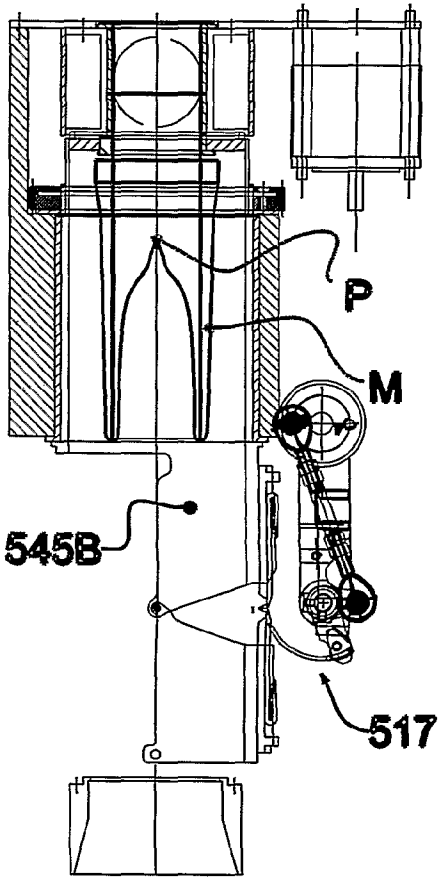
Figure 39:
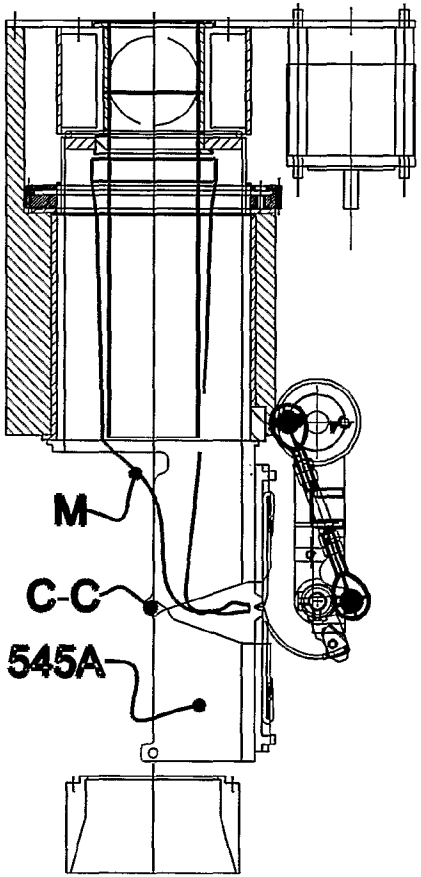
Figure 38:
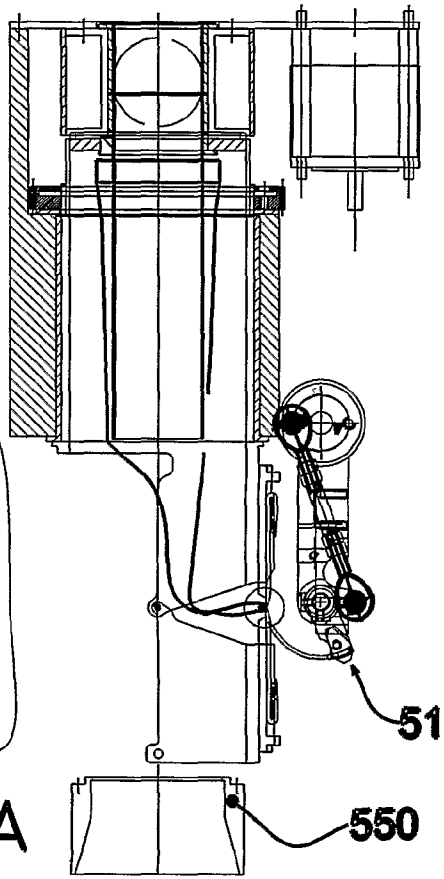
Figure 38A:
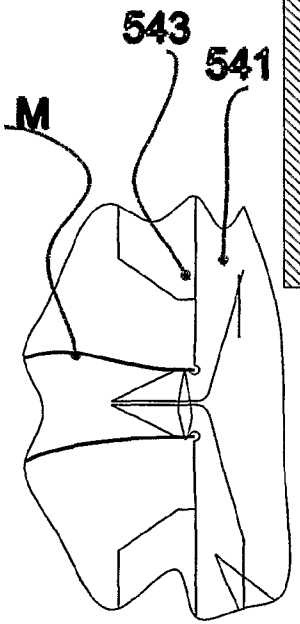
Figure 41A:
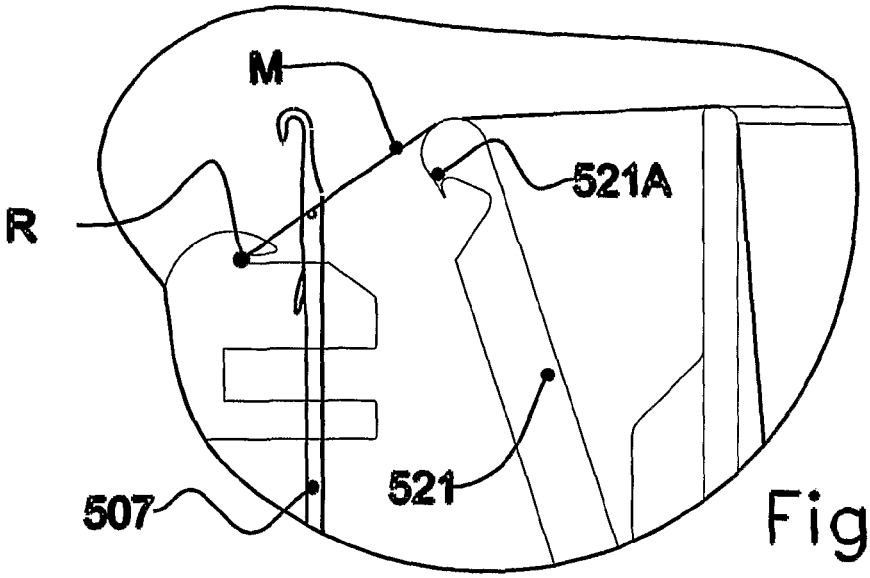
FIGS. 41, 41A, 42, 42A schematically illustrate, along a longitudinal section, a different transfer mode of the tubular textile fabric provided by the needles of the knitting machine onto the hooks of the pick-up device.
Figure 41:
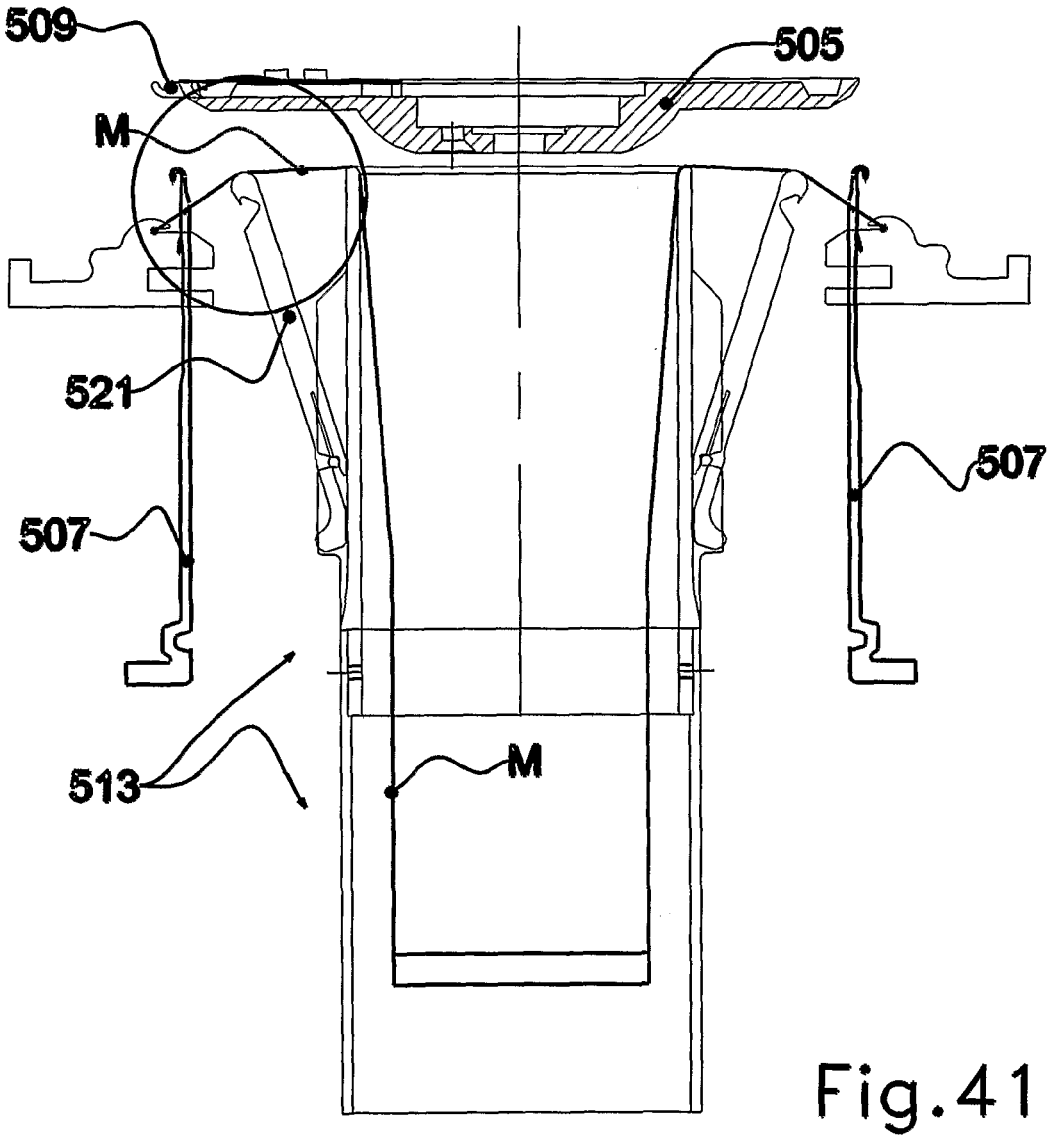
Figures 42, 42A:
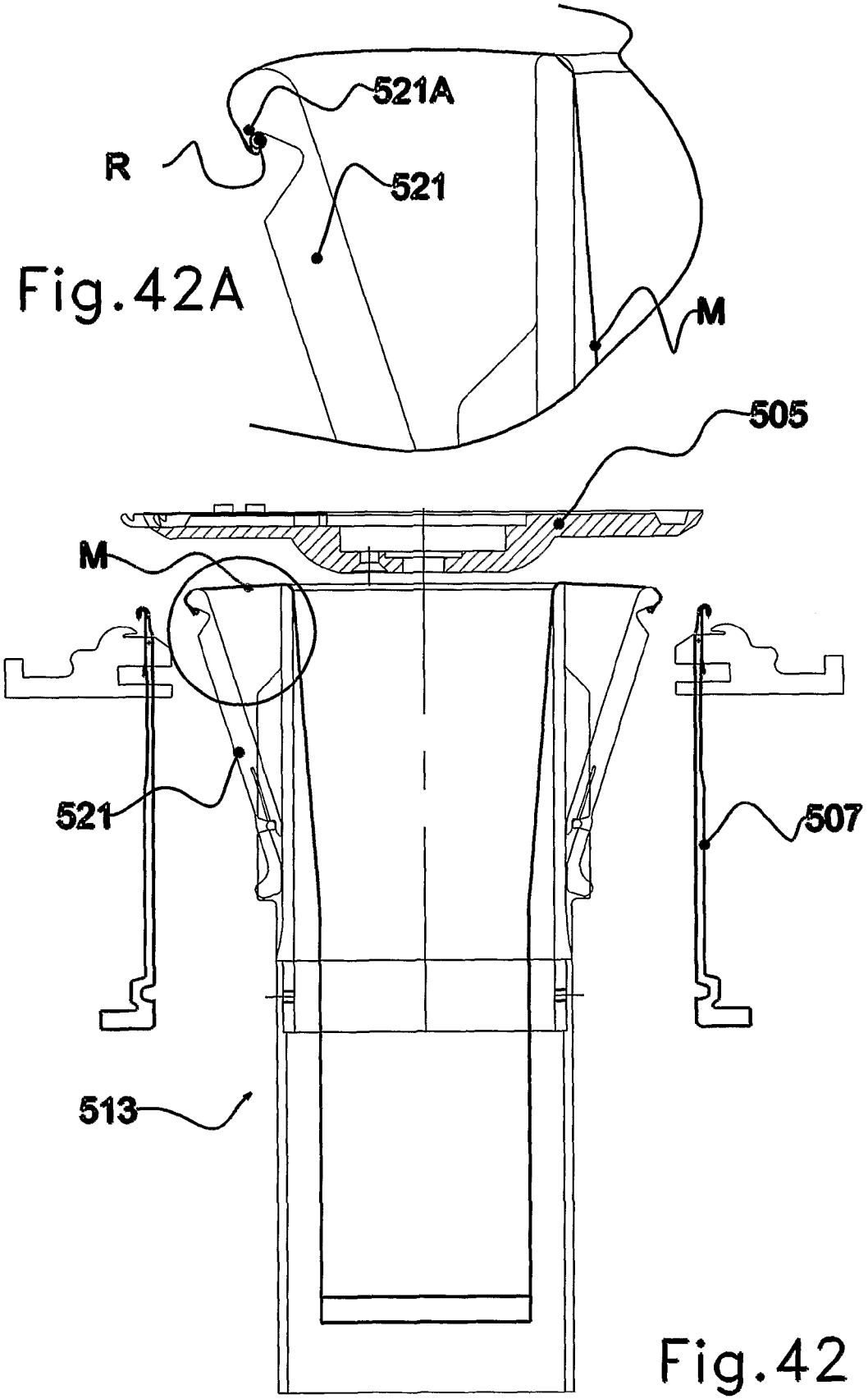

What is claimed is:

1. A system for knitting a tubular knit product and for seaming a toe of the tubular knit product comprising:

a textile machine having a cylinder of needles configured to manufacture the tubular knit product;

a pick-up device insertable inside the cylinder and carrying a rim of holding hooks arranged to extend outwardly for engaging the tubular knit product manufactured by the textile machine and to align longitudinally to enable a movement of the pick-up device within the cylinder of needles;

a sewing machine external to the cylinder of needles, the sewing machine seaming the toe of the tubular knit product; and a flip-over member coupled to the textile machine, the flip-over member comprising two facing portions hinged one to the other about a substantially diametrical overturning axis, each of the facing portions comprising harpoons disposed substantially perpendicular to the facing portion, wherein the harpoons receive the tubular knit product from the pick-up device, and wherein, by overturning one facing portion onto the other facing portion, the harpoons of the one facing portion dispose opposite to the harpoons of the other facing portion.

2. The system of claim 1, further comprising an aspirator duct operatively coupled to the flip-over member, the aspirator duct being configured to straighten and remove the tubular knit product engaged by the harpoons.

3. The system of claim 1, wherein the pick-up device is configured to rotate synchronously with the cylinder of needles.

4. The system of claim 1, wherein the textile machine comprises a dial having machine hooks, wherein the machine hooks are disposed to removably engage at least a portion of the tubular knit product, and wherein the pick-up device is actuated to engage, with the holding hooks, the at least a portion of the tubular stitch knit product held by the machine hooks.

5. The system of claim 1, further comprising a cam configured to extend and align the holding hooks.

6. The system of claim 5, wherein the cam is slidingly coupled to the pick-up device and cooperates with ends of the holding hooks, a movement of the cam profile causing the holding hooks to extend outwardly, an elastic member causing the holding hooks to align longitudinally.

7. The system of claim 1, further comprising an aspirator system disposed longitudinally in relation to the flip-over member, the aspirator system comprising two concentric aspiration channels configured to perform a first reversal and a second reversal of the tubular knit product.

8. The system of claim 1, wherein the harpoons comprise jackstraws for coupling stitches of the tubular knit product to the harpoons.

9. A system for seaming a toe of a tubular stitch knit product comprising:

a textile machine having a cylinder of needles configured to manufacture the tubular knit product;

a pick-up device for the tubular knit product, the pick-up device being disposed substantially coaxial to the cylinder of needles and being insertable within the cylinder of needles;

a rim of holding hooks carried by the pick-up device and disposed to radially extend outwardly to engage the tubular knit product manufactured by the textile machine and to align longitudinally to enable an axial movement of the pick-up device within the cylinder of needles, the rim of holding hooks engaging the tubular knit product and transporting the tubular knit product to an exterior of the cylinder of needles; and a sewing machine performing the closing of the toe, wherein the pick-up device comprises a substantially circular body subdivided in two symmetrical portions, each of the symmetrical portions comprising a half circle of the holding hooks and being hinged about a substantially diametrical overturning axis such to allow an overturning of one symmetrical portion onto the other, thereby carrying one half circle of the holding hooks in facing position with the other half circle of the holding hooks.

10. A method of knitting a tubular knit product having a toe and a border, and of closing the toe of the knit product, the method comprising:

manufacturing the tubular knit product, starting from the border and ending with the toe, with a knitwear machine comprising a cylinder of needles;

retaining the tubular knit product in position with knitting members of the knitwear machine;

inserting a rim of holding hooks within the cylinder of needles and translating the rim of holding hooks adjacently to the knitting members;

radially expanding the holding hooks for engaging a plurality of stitches of the tubular product;

causing the knitting member to release the tubular knit product;

radially retracting the holding hooks and removing the rim of holding hooks from the cylinder of needles;

substantially aligning the holding hooks with harpoons disposed in a first arc and a second arc of harpoons;

transferring the stitches engaged by the holding hooks to the harpoons;

overturning the first arc of harpoons against the second arc of harpoons, thereby causing the stitches of the tubular knit product engaged by the first arc of harpoons to be in substantial facing position with the stitches of the tubular knit product engaged by the second arc of harpoons;

sewing together the opposite stitches to close the toe; and causing the harpoons to release the tubular knit product.

11. The method of claim 10, wherein the holding hooks are extended again before transferring the stitches engaged by the holding hooks to the harpoons.

12. The method of claim 10, further comprising the steps of:

overturning the tubular knit product engaged by the harpoons before sewing, the overturning being performed by in an aspirator duct coaxial to the harpoons; and disposing again the harpoons after the sewing step in an annular arrangement by overturning the first arc of harpoons away from the second arc of harpoons, thereby causing a seam to be disposed within the annular arrangement.

13. The method of claim 10, wherein the knitting members are the needles of the cylinder of needles.

14. The method of claim 10, wherein the knitting members are machine hooks of a dial of the knitwear machine.

15. A method of knitting a tubular knit product having a toe and a border and for closing the toe of the knit product, the method comprising:

manufacturing the tubular knit product, starting from the border and ending with the toe, with a knitwear machine comprising a cylinder of needles;

retaining the tubular knit product in position with knitting members of the knitwear machine;

inserting a rim of holding hooks within the cylinder of needles and translating the rim of holding hooks adjacently to the knitting members;

radially expanding the holding hooks for engaging a plurality of stitches of the tubular knit product;

causing the knitting members to release the tubular knit product;

radially retracting the holding hooks and extracting the rim of holding hooks from the cylinder of needles;

overturning a first arc of holding hooks against a second arc of holding hooks, the first and the second arcs defining the rim of holding hooks;

carrying the stitches of the tubular knit product engaged by the holding hooks of the first arc to face the stitches of the tubular knit product engaged by the holding hooks of the second arc;

sewing together the opposite stitches to close the toe; and discharging the product.

* * * * *